US012753680B2

(12) United States Patent
Camargo et al.

(10) Patent No.: US 12,753,680 B2
(45) Date of Patent: Oct. 6, 2026

(54) SYSTEM FOR RESTORING THE MECHANICAL INTEGRITY OF SMALL-DIAMETER CASING OR PRODUCTION TUBING IN HYDROCARBON RESERVOIR WELLS

(71) Applicant: Instituto Mexicano del Petróleo, Mexico City (MX)

(72) Inventors: Rogelio Aldana Camargo, Mexico City (MX); Florentino Leyte Guerrero, Mexico City (MX); Rodrigo Buerhend Orozco, Mexico City (MX); Carlos Arturo González López, Mexico City (MX); Israel Herrera Carranza, Mexico City (MX); Jorge Alberto Villanueva López, Mexico City (MX); Edgar Kiyoshi Nakamura Labastida, Mexico City (MX)

(73) Assignee: Instituto Mexicano del Petróleo, Mexico City (MX)

( * ) Notice: Subject to any disclaimer, the term of this patent is extended or adjusted under 35 U.S.C. 154(b) by 0 days.

(21) Appl. No.: 18/821,612

(22) Filed: Aug. 30, 2024

(65) Prior Publication Data

US 2025/0075596 A1 Mar. 6, 2025

(30) Foreign Application Priority Data

Aug. 31, 2023 (MX) ..... MX/a/2023/010204

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 7,048,067 B1 * 5/2006 Cook ..... E21B 43/105 166/207
7,789,138 B2 * 9/2010 McGarian ..... E21B 29/10 166/191

(Continued)

OTHER PUBLICATIONS

Akisanya, A.R., Khan, F.U., Deans, W.F., Wood, P. (2011) "Cold hydraulic expansion of oil well tubulars." International Journal of Pressure Vessels and Piping 88(2011) 465-472. https://core.ac.uk/download/pdf/177413.pdf.

(Continued)

*Primary Examiner* — Taras P Bemko
(74) *Attorney, Agent, or Firm* — FisherBroyles, LLP; Jason P. Mueller

(57) ABSTRACT

Device for restoring the mechanical integrity of casing or production tubing in hydrocarbon wells with diameters of less than 4.5 inches. The device includes: a First Section (I) having a lower mechanical anchor; a Second Section (II) having a lower packer; a Third Section (III) having an upper connector; a Fourth Section (IV) having a plurality of longitudinally hollow cylindrical mechanical elements; a Fifth Section (V) having a finishing tool connector; a Sixth Section (VI) having an upper mechanical anchor; and a Seventh Section (VII) having an upper packer. A system including the device is disclosed for use in providing a permanent and resilient seal over splits, perforations and/or holes in the tubing. Procedures for evaluating the effectiveness of the device in a hydrocarbon well, recovering the device from a hydrocarbon well, and installing the device in a hydrocarbon well are disclosed.

30 Claims, 12 Drawing Sheets

(56) References Cited

U.S. PATENT DOCUMENTS

| | | | | |
|---|---|---|---|---|
| 9,447,651 | B2 * | 9/2016 | Hallundbæk | E21B 29/10 |
| 10,612,349 | B2 * | 4/2020 | Clemens | E21B 43/105 |
| 10,837,264 | B2 * | 11/2020 | Filippov | E21B 23/06 |
| 2012/0211222 | A1 * | 8/2012 | Leighton | E21B 29/10 166/208 |
| 2025/0122774 | A1 * | 4/2025 | Head | E21B 36/04 |

OTHER PUBLICATIONS

Al-Dossary, A, F., Al-warthan, A., Al-Badran, M., Al-Ghamdi, I. S., Mutawaa, W. (2017) "The Ideal approach for casing leak repairs in Old wells." SPE-188478-MS, Proceedings of the Abu Dhabi International Petroleum Exhibition & Conference held in Abu Dhabi, UAE, Nov. 13-16, 2017.

Anderson, T.D., Kulkarni, M.G., Kumar, A., Macia, M.L., Fairchild, D.P., Bardi, F. (2011) "Pipeline Integrity and Rehabilitation Technology: An Operator's Perspective." Proceedings of the Twenty-first International Offshore and Polar Engineering Conference Maui, Hawaii, USA, Jun. 19-24.

Ansari, A. A., Libdi, Z., Larsen, A. G. (2016) "Innovative Planning and Remediation Techniques for Restoring the Well Integrity by Curing High Annulus-B Pressure and Zonal Communication" IPTC-18894-MS, International Petroleum Technology Conference held in Bangkok, Thailand, Nov. 14-16.

Artificial Lift Systems (ALS), México Norte (N/A) "Manual Técnico para Sistemas Artificiales y Métodos de Producción aplicado para Pozos de Gas." Schlumberger, Carretera Reynosa Monterrey, México. Documento encontrado el 30 de julio de 2021 en el sitio web: https://www.academia.edu/31284860/Manual_T%C3%A9cnico_para_Sistemas_Artificiales_y_M%C3%A9todos_de_producci%C3%B3n_aplicado_para_Pozos_de_Gas.

Asher, S., Kumar, A., Fairchild, D., Nissley, N. (2012) "Investigating Remote Pipeline Repair using Laser Cleaning and Welding." Proceedings of the Twenty-second International Offshore and Polar Engineering Conference Rhodes, Greece, Jun. 17-22.

Bailey, B., Crabtree, M., Tyrie, J., Elphick, J., Kuchuk, F., Romano, C., Roodhart, L. (2000) "Water Control." Oilfied Review, Spring 2000.

Carballo, A. D. E., Granados, A. E. J. (2014) "Reparaciones mayores y menores en pozos petroleros." Tesis, Facultad de Ingeniería, UNAM, México. All Ch. 2 relevant.

De la Torre, R. E., Ramos, R. H., Jiménez y G. J. M: (2017) "Terminación y Reparación de Pozos Petrolíferos." Editorial Trillas, México.

Durongwattana, N., Toempromraj, W., Jedsadawaranon, P., Sompopsart, S. (2012) "Well Integrity Remediation—A Challenge for Swellable Technology." IPTC 15205. Proceedings of the International Petroleum Technology Conference held in Bangkok, Thailand, Feb. 7-9.

Forbes, C., Taggart, I. (1998) "Selective Isolation of Perforated Liners Using Casing Patches: Case Studies from North Sea Operations." IADC/SPE 39348. Proceedings of the 1998 IADC/SPE Drilling Conference held in Dallas, Texas Mar. 3-6, 1998.

Gorrara, A., Hazel, P., Tavendale, F., Louden, F (2005) "Development of a Gas-Tight External Casing Patch Using Direct Hydraulic Expansion of Standard Casing to Achieve a Permanent Load Bearing Connection." SPE/IADC 92583, Proceedings of the SPE/IADC Drilling Conference held in Amsterdam, The Netherlands, Feb. 23-25, 2005.

Herrera, H. J. (2020) "Ingeniería de la perforación de pozos de petróleo y gas. vol. III Sistemas básicos y procesos de los equipos de perforación." Laboratorio de Innovación en Tecnologías Mineras, Escuela Técnica Superior de Ingenieros de Minas y Energía. Universidad Politécnica de Madrid, Madrid, España. Relevant pp. 54-56, 163. https://oa.upm.es/62720/1/INGENIERIA_POZOS_PETROLEO_Y_GAS_Vol-3_LM1B5T3R0-20200323.pdf.

Hill, D., Ertekin, A., Sridhar, A. N., Scott, C. (2009) "Performance of composite materials in corrosive conditions: cathodic disbondment of composite materials and modeling of a composite repair patch for pipelines" Paper 09329, Proceedings of NACE International Corrosion Conference & Expo.

Ho Yin Yap, Leong Hing Chua, Fidelis Sipangkui, Brian Rayner, B., Peng Yoke Low, Bato Connie (2021) "Innovative Remediation Techniques for Restoring Well Integrity with Coil Tubing Patch." SPE/IADC-202177-MS, SPE/IADC Middle East Drilling Technology Conference and Exhibition, Abu Dhabi, UAE, May 25-27, 2021.

IADC (2005) "Expandable technology enables casing repairs." International Association of Drilling Contractors, January-February issue.

Innes, G., Morgan, Q., Macarthur, A., et al. (2005) "Next Generation Expandable Completion Systems." SPE/IADC 97281; also SPE 106342.

Johns, J.E., Cary, D.N., Dethlefs, J.C., Ellis, B.C., McConnell, M.L. Schwartz, G.L. (2007) "Locating and Repairing Casing Leaks With Tubing in Place-Ultrasonic Logging and Pressure-Activated Sealant Methods." SPE 108195, Proceedings of the Offshore Europe 2007 held in Aberdeen, Scotland, U.K., Sep. 4-7, 2007.

Julian, J. Y., Cahalane, T. W., Cismoski, D. A., Burton, J., Savage, E.L. (2006) "Rigless Tubing Repair Using Permanent and Retrievable Patches at Prudhoe Bay, Alaska." SPE 104055, Proceedings of the First International Oil Conference and Exhibition in Mexico held in Cancun, Mexico, Aug. 31-Sep. 2, 2006.

Karev, V., Kovalenko, Y., Ustinov, K. (2020) "Geomechanics of Oil and Gas Wells." Springer; Advances in Oil and Gas Exploration & Production. Springer Nature Switzerland AG.

Li Tao, Shan Gao, Qiang Chen, Yiliang Li, Weiye Han, Xiuling Bi, Qiang Sun (2013) "Innovative Design of the Solid Expandable Tubular to Patch the Casing: Area Below the Previously Installed Expandable Tubular" IPTC 16429, International Petroleum Technology Conference, Beiging, China, 26-28 de marzo.

Li Tao (2015) "Solid expandable tubular patching technique for high-temperature and high-pressure casing damaged wells." Petroleum Exploration and Development, vol. 42, Issue 3, Jun. 2015.

Neely, J. D. (1985) "The use of casing patches to improve workover success rates." SPE13996. Proceedings of the Offshore Europe 85 Conference in Conjunction with the Society of Petroleum engineers of AIME held in Abeerden, Sep. 10-13, 1985.

Mackenzie, G., McLelland, A., Carragher, P., Fulks, J., Mason, D. (2022) "Innovative and Collaborative Well Intervention Solution Restores Well Integrity to Compromised Completion." SPE-209036-MS, Proceedings of the SPE/ICoTA Well Intervention Conference and Exhibition, The Woodlands, Texas, USA, Mar. 22-23, 2022.

Noble, L., Rees, H., Langnes, T., Thiruvenkatanathan, P. (2021) "Using Distributed Fibre Optic Sensing to Recover Well Integrity and Restore Production." SPE-204450-MS, Proceedings of the e SPE/ICoTA Well Intervention Conference and Exhibition to be held virtually on Mar. 22-25, 2021. The official proceedings were published online on Mar. 15, 2021.

Plaxton, B., Pehlke, T., Baxter, D., Crockett, M., Kaiser, T. (2018) "SAGD Production Casing Failure Diagnosis and Repair." SPE-193362-MS, Proceedings of the SPE Thermal Well Integrity and Design Symposium held in Banff, Alberta, Canada, Nov. 27-29, 2018.

Qamar, S. Z., Akhtar, M., Pervez, T. (2021) "Swelling Elastomer Applications in Petroleum Drilling and Development—Applications, Performance Analysis, and Material Modeling." IntechOpen Limited, London, UK. Documento encontrado el 25 de julio de 2022 en el sitio web: https://www.intechopen.com/books/10159.

Rodenboog, C. (2001) "A novel approach for tubing repair in a HPHT well." SPE 68417, Proceedings of the SPE/ICoTA Coiled Tubing Roundtable held in Houston, Texas, Mar. 7-8, 2001.

Sadigov, T., Thiruvenkatanathan, P., Sheydayev, A. (2017) "Application of Distributed Acoustic Sensing DAS Technology in Identification and Remediation of Sand Producing Zones in OHGP Completion." SPE-188991-MS, Proceedings of the SPE Annual Caspian Technical Conference and Exhibition held in Baku, Azerbaijan, Nov. 1-3, 2017.

Saltel, B., Gonzalez, L., Trevor McIntosh, T., Weems, M. (2015) "Restoring Casing Integrity Using an Expandable Steel Patch Prior to Drilling Ahead With Minimal Reduction of Next Hole Size."

(56) References Cited

OTHER PUBLICATIONS

SPE-174524-MS. Proceedings of the SPE Well Integrity Symposium held in Galveston, Texas, USA, Jun. 2-3.
Short, J. A. (1981) "Fishing and Casing Repair." PennWell Publishing Company, Tulsa, Oklahoma, US.
Smalley, M. T., Rae, G. (2001) "Use of Corrugated Material Technology to Provide Low-Risk Solution to Repair Connector Leakage on the Captain Field, UKCS." IADC/SPE 7288, Proceedings of the IADC/SPE Middle East Drilling Technology held in Bahrain, Oct. 22-24, 2001.
Styler, J. W., Al-Suwailem, S. S., Akhnoukh, R. L., Leighton J.R. (2001)"A Unique Rigless Casing Leak Repair, Ghawar Field, Saudi Arabia," SPE 68129, SPE Middle East Oil Show, Bahrain, Mar. 17-20. Citado por Karen Bybee, J. Pet. Technol. 53 (06): 28-29. Paper No. SPE-0601-0028-JPT.
Todd, L., Cleveland, M., Docherty, K., Reid, J., Cowan, K., Yohe, C. (2018) "Big Problem-Small Solution: Nanotechnology-Based Sealing Fluid." SPE-191577-MS, Proceedings of the 2018 SPE Annual Technical Conference and Exhibition held in Dallas, Texas, Sep. 24-26, 2018.
TTS, "Casing Patch Specifications" Pagina web encontrada el 12 de noviembre de 2022, en la dirección de internet: http://www.thrutubingsystems.com/intervention-products-and-services.php?product=/x-span-tubing-and-casing- patches/casing-patch-specifications.
Weatherford (2016) "HOMCO Cassing Patch. Restoring casing integrity with a permanent Steel seal." Weatherford Co. Documento encontrado el 14 de noviembre de 2022 en el sitio web: https://www.weatherford.com/documents/brochure/products-and-services/intervention-and-abandonment/homco-casing-patch/.
Xu Lin, Jiang Mengchen, Xu Jie, Xu Mingbiao, Meng Shuang, Wang Dongxu (2020) "Design and plugging property of composite pressure activated sealant." Natural Gas Industry B 7, pp. 557-565.
Yufei Sun, Anyu Fang, Wenmin Fan, Zhiyong Chen, and Sheming Liu, Yang Wang, Li Li, Xiaoming Zhang, Chunlong Luo (2019) "Applying Epoxy Resin Technology on Remediation for 3.5 in. Casing Leak: Case Study, South Sulige Gas Field." SPE-196503-MS, Proceedings of the SPE/IATMI Asia Pacific Oil & Gas Conference and Exhibition held in Bali, Indonesia, Oct. 29-31, 2019.

* cited by examiner

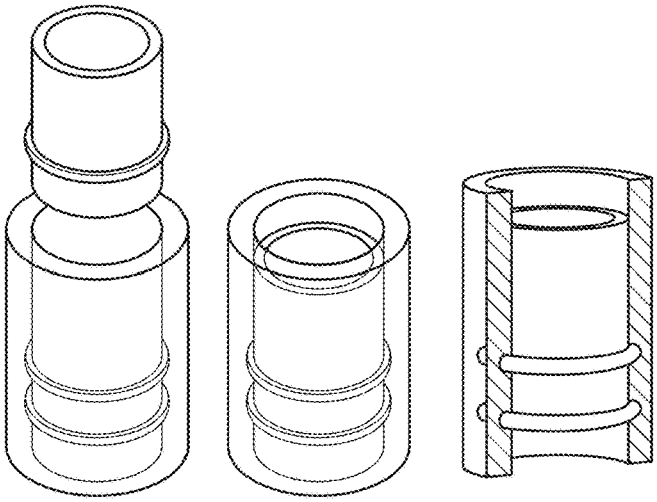
FIG. 5D (Prior Art)
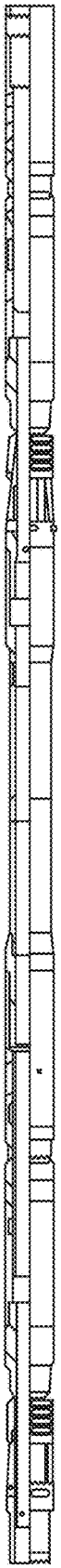
(Prior Art) FIG. 6

SYSTEM FOR RESTORING THE MECHANICAL INTEGRITY OF SMALL-DIAMETER CASING OR PRODUCTION TUBING IN HYDROCARBON RESERVOIR WELLS

CROSS-REFERENCE TO RELATED APPLICATIONS

This patent application claims priority under 35 U.S.C. Section 119 to Mexican Patent Application No. MX/a/2023/010204, filed Aug. 31, 2023, the entire disclosure of which is incorporated herein by reference.

TECHNICAL FIELD OF INVENTION

Production tubing (TP) or casing (TR) anomalies, which include holes, drillings or splits, can occur during design, drilling, completion, production and throughout the productive life of a hydrocarbon producing well; such anomalies can have diverse origins ranging from inappropriate design due to lack of knowledge of future operating conditions to erosion and corrosion damage; they are also done intentionally, for example, to increase production or are caused by changes in the producing interval.

The set of techniques developed in the present invention is oriented to the conclusion of an integral technology to restore the mechanical integrity of either, casing or production pipes of reduced diameter. Thus, this invention is inscribed within the technologies used for repair and maintenance operations of wells in hydrocarbon reservoirs.

BACKGROUND TO THE INVENTION

This section discloses the various disclosed aspects of the art which may be associated with practices of the present invention, and its goal is to provide a framework to a better understanding of the particular aspects; accordingly, this section should be interpreted in this sense and not necessarily as acceptance of the prior art.

It should be noted that, in the description of this patent application, English system units are also used because all the infrastructure for drilling, completion, production and transportation of hydrocarbons is designed and manufactured in the aforementioned units, including pipes, accessories, components and tools.

Exploration, development and production processes in oil and gas wells include activities that involve different risks to the environment, personnel and facilities; in particular, casing and production pipelines are exposed to failures due to the events described in Table 1 (Short, 1981; U.S. Pat. No. 9,587,460 B32; Ho Yin Yap Ft al., 2021; Carballo et al., 2014; CNH, 2014, De la Torre et al, 2017; Karev Ft al., 2020; ALS, N/D).

TABLE 1

Events causing pipeline failures

| Stage | Events |
|---|---|
| During planning and design of the borehole | Design oversights.<br>Inappropriate design due to lack of knowledge of future operating conditions.<br>Changes in the program scope.<br>Movement of massive plastic salt formations leading to collapse.<br>Permafrost sections and tremor sensitive areas which require appropriate safety factors. |
| During drilling | Wear during drilling below the pipe.<br>While sliding into the hole.<br>Pipe excessive pulling when getting stuck.<br>Excessive pressures such as when a cement plug is hit too hard when cemented, which can blow out a pipe section;<br>By asymmetric pressures in inclined wells, notably in anisotropic layered formations where the pressure system is asymmetric with respect to the wellbore longitudinal axis.<br>Due to contact between TR and TP in major directional changes.<br>During fishing operations inside or below the pipe, by use of tools inside it and excessive rotations. |
| During termination operations | Completion operations can also cause pipe failure by collapse.<br>Gun shot failures resulting in unwanted holes.<br>Pipe settlement inducing excessive stresses and potential failure after less than normal wear. |
| During the wells productive life | Pipelines can fail due to both, internal or external corrosion.<br>They can also be damaged by well wear.<br>They can be damaged by erosion during solids production. |
| Pipe manufacturing processes | Pipes can also fail due to undetected defects and/or general weaknesses in it. |
| Combined failures | Combinations of the above.<br>One type of failure can lead to others. |
| Intentionally drilled holes, in the pipeline | In test areas.<br>In producing areas.<br>To increase production in gas producing areas with high liquid load.<br>By change of producing interval. |

In general terms, anomalies due to the events outlined above can be grouped as: a) intentionally made alterations and b) pipe damage. These two groups are listed below in Table 2 and illustrated in FIG. 1 (Short, 1981; Herrera, 2020;

De la Torre; 2017); be aware that the letters within Table 2 and FIG. 1 coincide with each other.

Other production rig failures include:

a) Packer failure due to overstressing, b) Blocking of a sliding liner, safety valve and/or damage to surface equipment due to formation sand or proppant production, c) Fish not recovered.

Other problems associated with injection wells include the following (Innes et al., 2005):

a) Thief zones taking most of the water, opposed to remediation by pressurized cementation.

b) Changes in the TR profile such as ovalization, which may create anomalous stress concentrations and make remediation difficult.

c) Highly corroded zones in the TR.

Anomaly and leak detection technologies. Nowadays, there are both, indirect and direct ways to detect anomalies and leaks in tubing (TP) and casing (TR). The former include irregular monitoring and logging during completion and/or production, e.g. temperature monitoring, thermal decay logging and acoustic signals for fluid flow and leakage events, including a derived form technology of the latter phenomenon which is called "Distributed Acoustic Sensing" (DAS) (Noble Et al., 2021), and direct forms including the use of tools such as ultrasound (USIT), Corrosion Evaluation Tool (CET), Multifinger Caliper (MFCT), Electromagnetic Imaging Tool (EMIT) and use of video cameras; on the other hand, pipeline detection devices (PIG), magnetic flux leak detection tools and other resources such as pressure tests are used for pipelines. New materials, equipment and techniques have also contributed to the development of new TP and TR repair technologies, which are described below.

Flexible patching. Technologies used in the industry for repairing damaged or perforated pipes include the placement of flexible patches or other materials that are placed over high-strength inflatable elastomeric pneumatic elastomeric devices similar to packers (Toshikasu Igi, U.S. Pat. No. 9,481,156 B2; Bailey et al. U.S. Pat. No. 9,481,156 B2; Bailey Et al., 2000; Japanese patent No. JP200120653A; Styler Et al, 2001). FIG. 2 schematically illustrates common features of these technologies; the next steps are common to these techniques:

a) Drilled or damaged pipe (FIG. 2-I);

b) A pneumatic device (FIG. 2-II-i) having on its outer surface a patch formed by a cross-linked mesh of resistant particles such as glass, carbon or other similar fibers, embedded in a resin curable under water, with heat or other catalyst, is placed at the height of the holes in the pipe (FIG. 2-II-j);

c) The pneumatic device with the patch is expanded until the later is in contact with the inner face of the perforated pipe (FIG. 2-III);

d) Then the resin curing is triggered, keeping the pneumatic device in place until curing is complete and the patch is hardened and adhered to the inside face of the damaged pipe;

e) The pneumatic device is decompressed and removed leaving the patch in place, sealing the area where the perforations or damages are located (FIG. 2-IV).

TABLE 2

Source and form of alteration in casing and tubing.

| Source of the alteration | Type of alteration (FIG. 1) |
|---|---|
| Intentionally made holes in the pipeline | a. Shots;<br>b. Drilling to channel gas pockets, test drilling, changes in producing intervals due to interdigitation problems or incorporation of new intervals. |
| Unintentional damage to the pipeline | c. Foreign object encrustations during re-entries or deepening;<br>d. Fractures;<br>e. Regions of weakness in the pipes, due to manufacturing irregularities or induced by shocks, for example, when the rod works in compression, also when it contacts stabilizers, reamers and others, especially in inclined sections of wells.<br>f. Inclusions of mineral and/or metallic particles (slag) in the pipe wall due to alterations in its production;<br>g. Alterations in the wall due to local or generalized corrosion or other chemical attack by formation fluids, incompatibility of working fluids and/or water or gas invasion.<br>h. Pipe bursting is a manifestation of the occurrence of a sudden internal load greater than the external load, and which exceeds the material's resistance to internal pressure; also Wall collapse due to formation thrust or negative pressures caused by sudden changes in internal pressure;<br>i. Other damaging sources include:<br>Hydraulic-related pipeline failures during drilling: fatigue failures, buckling vibrations, twisting, sticking, collapse, fractures and explosion ruptures; Hossain et al. (2018) present a broad description of this type of failures.<br>The damage can be due to erosion by fluid flow, such as when passing through a choke; it has been correlated with the density of the fluid and the erosion rate, the latter related to temperature and pressure with the expression:<br>$v_e = C_4/\rho_g^{0.5}$ where $75 < C_4 < 150$ for T0 = 60° F. y p0 = 14.7 psi.<br>Another cause of damage is leaks in superficial aquifers that contain corrosive waters with $CO_2$ and $H_2S$ gases; they are considered thief zones. |

Alternative to the previously described patches, a section of pipe is trimmed longitudinally forming two additional faces from end to end, as indicated in FIGS. 3-*k* and 3-*l*, and modified in such a way that an elastic restoring force is induced. by post-forming in the direction of its longitudinal cut; Its outer peripheral length is equal to the inner peripheral length of the pipe to be repaired. An adhesive is also applied to this section of pipe on its exterior face, then it is inserted to the depth of the damaged area and expanded pneumatically as described in the Japanese patent application JP2001-20653A, until its outer face adheres to the inner face of the pipe, in that position the adhesive cures and remains until the adhesive hardens; the inventors also suggest the formation of steps on these faces (FIG. 3-*m*) also form a mechanical interference bond and hold this patch even more rigidly in place.

Observations relevant to these technologies include: a) the requirement that the pneumatic device must be kept expanded against the patch and the inner wall of the pipe as long as necessary for the resin to cure, harden and rigidly adhere to the pipe, b) The total length of each patch is limited by the length of the pneumatic device, typically no more than two meters, so only one patch of limited length can be applied at a time, wait for it to be installed, then remove the pneumatic device and start placing another patch, this, in cases of large lengths of pipe to be repaired, increases downtime, delays production and increases operating costs; c) a detailed analysis is necessary to evaluate the resistance of these patches since the positive pressure differentials inside the pipe can detach and/or damage the patch; Another relevant aspect to consider is the use of materials whose corrosion potential is different from that of the pipe, this can induce accelerated corrosion in the contact zone between the patch and the pipe, d) these devices, due to their installation principle, are not available for pipe diameters smaller than 88.90 mm (3.50 inches), e) finally, when the walls of the patch are significantly small, they are more susceptible to impacts; Hill et al., (2009) have reported that after a physical impact, patches made of composite materials, when exposed to environmental humidity combined with cathodic currents, can induce a type of corrosion where both, adhesion between the material substrates and cathodic protection are lost.

Optional to the previously described patches, Tao Li Et al. (2013) propose a hydraulic and a mechanical device to expand a metal patch in a damaged section of casing (TR) below an expanded tubular patch in the TR, relevant weight and dimension considerations of the expansion systems include the need to place these patches with repair equipment; the reduction of the space between the PT and the TR, and the size of the devices expansion prevent applying this technology to small diameter production pipes; Additionally, there is an important consideration is the use of metal patches whose corrosion potential is different from that of the pipe, since this can induce accelerated corrosion in the contact zone between the patch and the pipe. Alternative to the previous technology, Neely (1985) presents a technology to install metal patches, up to five feet in length, expandable in areas where there are leaks; here a hydraulic piston expands the lower wall of the patch against the wall of the casing causing both, the contact and anchoring, and initiates the sealing; The piston slides upward, expands and causes the metal patch to expand until it covers the damaged area or the five feet length; The reference indicates that the installation time is thirty minutes for a ten foot patch, finally the piston is removed and the metal patch is tested for tightness. As indicated in the document, repair equipment is required to install this type of patch. Furthermore, the contact between the expanded metal patch and TR does not guarantee airtightness. Additionally, due to the nature of the technology, it can only be applied to large diameters of pipe, potentially larger than 4.5 inches. Similar technologies (Forbes, 1998) have been used extensively for restrictive 4.0-inch diameters in North Sea wells using coiled tubing.

Hydro-expandable patches. With the development of new materials, their applications have also multiplied in the petroleum industry. Among these materials are elastomers, which have been used intensively in seals, gaskets and as main elements of some packers. A particular type of those are the so-called hydro-expandable elastomers (Quamar Et at., 2021); These polymers swell by absorption when exposed to an appropriate oil- or water-based agent, in particular, when installed on steel pipe, they have been used as patches to repair casing pipes (Durongwattana et al., 2011) in the LKU-A01 well, in the central plain of Thailand; FIG. 4 illustrates the most notable stages of this technology, it shows a section of damaged pipe (FIG. 4-*n*), in which a pipe with a smaller diameter than the one to be repaired is inserted; The experience presented in this reference indicates that in the smaller diameter pipe, a layer of elastomer that reacts to fresh water has been mounted, so for its installation, a repair tower is required that is placed at the head of the well, a wire bristle cleaner or reamer is inserted to clean the pipe in the patch area; next, the thinner pipe is inserted, in which the elastomeric patch is placed using a KCl brine saturated (FIG. 4-*o*), designed to prevent premature expansion of the patch.

The description of this system considers that the maximum design expansion time is greater than 10 days, considering that the rapid expansion agent is water; Additionally, we must wait for the patch to expand before placing another one; With respect to the diameters, pipes of 139.700 mm (5.50") in devices up to 4.267 m (14 feet) in length may be used, additionally a 10% KCl brine is used so that the patch makes proper adhesive contact with the TR in a minimum of 5 to 27 days to prevents premature swelling, finally repair equipment is used for the patch installation.

Permanent patches. Another type of expansion patches, (Gammill, C., 2017, U.S. Pat. No. 9,587,460 B2; Gammill, C., U.S. Pat. No. 10,612,349 B2; Julian et al., 2006; Weatherford, 2016), sometimes called soft patches, are made of low carbon steel or 300 series stainless steel, which may include a molded polymer on the outside or inside, they have been used successfully in pipes larger than 4.50 inches, these patches, when expanding within the area of interest, provide metal-to-metal contact "adapting" to the surface of the damaged pipe, where the polymer provides support for the insulation, Julian (Op. Cit., Weatherford, 2016) notes that they are less expensive than retrievable patches. Binggui Xu et al. (2020) have developed a sealing system with presumably polymeric cones expanded by means of hydraulic cylinders combined with an assembly of cones that expand to achieve anchoring. The double mechanical-hydraulic system involved requires precise control of the location and it is anticipated that its operation and weight will require repair equipment. It is considered too heavy for a steel line, nor are the diameter ranges indicated to apply this tool, but considering the double system, it is anticipated to be applicable to large diameter pipes, typically greater than 114.30 mm (4.50 inches).

Caccialupi Et al., 2018, in U.S. Pat. No. 10,132,141 B2, has developed a variant of permanent patches that considers the existence of geometric restrictions such as nipples, unions or other types of similar elements in the leaking area;

in this case, patches have been developed with sealing components with jaws above and below the area affected by leaks or other perforations; These jaws are designed not to exceed, when expanded, the inner diameter of the pipe that includes the indicated geometric restrictions, in such a way that a seal is created with an elastomeric ring or a protrusion, similar to that of packers, but only in specific points above and below the affected area. The expansion is carried out with a main expansion element that slides on a longitudinal axis with hydraulic pressure by means of pistons. Although this device may include a mechanical anchor, there is the possibility that it does not include one, and the seal is made by means of the elastomeric elements, in such a way that a redundant docking system is foreseen. An advantage of this system is that it can be installed with steel line. This type of device does not consider the potential cyclic compression and expansion deformations in the conduction line due to changes in the flow regime, since once the mechanical anchors are installed there is no possibility of longitudinal movement. Another important consideration is that this device and patch are designed for pipe of casing as indicated in the summary, typically with diameters greater than 114.30 mm (4.50 inches). Due to the weight of the necessary equipment and the dimensions of the patch itself, repair equipment is used; On the other hand, the dimensions of the equipment make them available for pipes diameter of 4.50 inches or larger; additionally, the selection of the low carbon or stainless-steel metal patch must consider the minimization of galvanic pairs between these materials and the damaged pipe in order to avoid accelerated corrosion of the patch-pipe system. Finally, the effectiveness of metal-metal contact for sealing must be carefully evaluated. Julian et al., (2006) in a study of 263 permanent and recoverable patches installed in fields in Prudhoe Bay, Alaska, indicates that soft patches had an effectiveness less than 70%, with the main failures being immediately after installation and leaks after the patch has been installed, presumably at the patch-pipe contact. Other authors (Tao Li, 2014) point out that expandable pipes (SET) have a low success rate in thermal recovery wells under high temperature conditions or high-pressure injection wells.

Recoverable patches. Generally speaking, these patches can be classified by the number and characteristics of the fixing elements of the patch, by the number and properties of the insulation elements and the specific properties of the installation/removal system, as well as by the number of trips necessary for their installation, are also characterized by the materials used and the range of diameters where they are applied. Typically, they are made of carbon steel or stainless steel, new coatings based on titanium or aluminum nitrates or tungsten carbide (Li Tao, 2015) improve their resistance properties to high temperatures and pressures; Their diameters (ID) are typically larger or equal to 108.610 mm (4.276 inches) (TTS) and are installed in one, two or up to three trips, depending on their design; those installed in one trip include packers that are fixed with a spacer tube that connects them and inside the spacer tube is another tubular element that provides the necessary force to adjust the lower gasket and extrude it to the pipe wall intended to be isolated, all in one trip. Two-trip systems typically include two packers at each end of the retrievable patch and an inner tubular member that connects both packers, and whose length is designed to isolate the damaged area of the pipe to be isolated. In each trip, a docking element is fixed between the patch and the damaged pipe, together with the sealing element and the insulating jackets in the damaged section. The literature investigated shows that there are different approaches in the design and operation of docking elements (FIG. 5), there are those whose docking works mainly by friction surfaces (and forces) (FIG. 5*a*), while others work by in situ penetration, while others work by in-situ penetration of toothed profiles, which causes them to work by compression and friction, formed into expandable elements installed in a tubular element (FIG. 5*b*); a variant of the latter includes tungsten carbide inserts on the surfaces of the toothed profiles (FIG. 5*c*), to provide larger mechanical interlock; Another type of anchoring includes in the design, channels on the wall of the TR, where protrusions included in the device are mechanically inserted to achieve mechanical interference, as illustrated in FIG. 5*d*.

Mullins (2016) describes a device in the U.S. Pat. No. 9,453,393 B2 whose objective is to install a jacket in a well that has a casing, The device for installation includes the use of Viton type packers and anchors installed alternately along the device, the anchors are installed with a mandrel system that activates them when a rotational moment is applied; Although the objective of this device is to install a sleeve at the bottom of a well, the diameters in which it is manufactured are not clearly established; however, the use of repair equipment or at least a mast with equipment to apply torsion in the installation line of their FIG. 12 is anticipated, also, the term "work string" is used throughout that document. The use of repair equipment, by its very nature, has inherent greater operational complexity; it requires the movement and installation of mast service units, fluid pumps, storage units and tools, in addition to anticipated production losses for several weeks at a very high costs associated with the use of work equipment.

The hermeticity of the patches is mainly achieved by three mechanisms, a) that which involves metal to metal contact, b) that which includes devices made of rubber compounds or elastomers type ring-seals or chevron type and c) combinations of the previous ones. Special consideration is required during the design of these sealing mechanisms; In an analysis of failure mechanisms of recoverable and permanent patches, in Prudhoe Bay fields, from 1985 to 2006, Julian Et Al., (2006) points out that 26% of the wells analyzed were due to a second leak, 28% were due to leaks in the patch, 19% of the failures were due to unsuccessful installation operations, 8% were due to sticking during traveling (lowering or raising), 4% to imprecise placement and the remaining 15% to unknown causes.

In relation to casing, Al-Dossary Et Al. (2017) has reviewed the types of leaks existing in these pipes in five different oil fields, in the same geographical region, presumably in Arabia, which adds particular regional geological characteristics that allow him to classify the observed leaks into the following three types, a) the first scenario includes leaks crossing superficial aquifers, therefore located at a shallow depth that carry corrosive waters with $CO_2$ and $H_2S$ gases, and is considered a thief zone and difficult to seal; b) the second type occurs when the leak occurs in formations with highly pressurized formation water, without cementation around the casing, these waters are corrosive and contain $H_2S$, which corrode the pipe quickly; and, c) the third type of leaks, according to the authors, is due to different factors including metal losses, damaged couplings, leaks in the diverter valve, coupled with low quality cementation, cement aging, inappropriate cementitious mixture or poor cementing practices and their consequences. Al-Dossary concluding remarks highlights the circumstances in which the leaks are presented and proposes, what he considers, the best practices and tools of the above scenarios for the best treatment of the leaks in its Table 1, and the corresponding procedures for the repair of the leaks in diagrams 1 to 3 of their paper. It is important to note that these solutions require repair equipment and are available for TRs greater than 114.3 mm (4.5 inches).

Patches with packer and cementation. Ansari et al. (2016) have proposed the use of a technology called HidraWell, designed to restore the integrity of casing pipes. The authors emphasize the need to conduct extensive investigations prior to the mobilization of workover teams, to accurately determine the integrity condition of a hydrocarbon well when the second safety barrier in the annular region or barrier B has failed; This remediation technology is proposed as an alternative to grinding and replacing the damaged section and re-cementing of 244.475 mm and 339.725 mm pipes (9⅝" and 13⅜"); This technology includes a tool that has a packer and its guard and a clamping piece to control a grinding section at the front; Prior to the installation of the grinding section, the packer is installed and the section to be isolated is cemented, then the grinding section is installed and the cemented area is penetrated to allow the flow of fluids through it, as indicated in FIG. 4, included in the drawings section of the present patent application. The use of these and other similar technologies is widely widespread (Julian Et Al., 2006; Smalley Et al. 2001; Gorrara, Et al. 2005; Julian Et Al., 2006, Saltel Et Al., 2015, Akisanya Et Al., 2011, Sadigov Et Al., 2017), and due to their very nature, similar conclusions can be obtained, including: since they are designed for large diameters, they require repair equipment with or without cementation with the following restrictive conditions:

a) The use of repair equipment, by its very nature, has inherent greater operational complexity, requiring the movement and installation of mast service units, fluid pump, storage units and tools.
b) Killing the well is required.
c) If they exist, the extraction of recoverable packers and grinding of the permanent ones is required.
d) There are production losses for several weeks.
e) There is potential damage to the formation from using chemicals in the working fluids.
f) The costs of these technologies associated with the use of work equipment are very high.

Other limitations are related to the fact that these tools are not designed for diameters smaller than 114.3 mm (4.5 inches), those that include front cementation rely on good adhesion between cement and pipe, and the efficiency relies on one or two packers and/or the impermeable contact between the metal patch and the TR or TP.

Inflatable packers. These technologies have been important for cases of uninterruptible operations such as work under high pressures during the drilling of wells. These packers easily pass through restrictions, are very resistant and withstand high pressure demands, however, their use is risky in wells where pressures and temperatures are at the maximum limit of these devices (Rodenboog, 2001), additionally since these inflatable packers are subject to high pressures in high temperature environments, when deflated, they tend to include a plastic deformation component, in addition to elastic deformations; Mackenzie et al. (2022) points out that these plastic deformations are not recoverable, which may require additional tension at the time of extraction and therefore brushing or erosion and even damage to the packers surface.

Methods with pressure-activated sealing materials. This technology includes the use of sealing materials that polymerize (solidify) only where the leak remains active and a pressure differential exists, otherwise they remain fluid (Johns Et Al., 2007). The authors point out that a great advantage of this technology is that unused material is removed by mechanical methods and does not present difficulties for future maintenance operations. The following aspects are highlighted as relevant when designing a solution based on these technologies: the accurate detection of fluid leaks is very important and conventional recording methods are not the most appropriate, on the other hand, the electromagnetic tool (EMIT) to obtain images is designed to quantify the loss of metal along the TR, but it does not distinguish whether the leak is into or out of the pipe; in addition, some tools such as those dedicated to temperature measurement, noise registers and/or caliper could mask leaks. The authors point out that the best method are ultrasound based methods. However, it is necessary to consider that the effectiveness of its sealing depends on the size of the leak; the larger it is, the more complications there are in using this technology, since it requires specific periods of time, that include: the time necessary for the sealing agent to reach the area of the leak, plus the curing time that requires 18 or more hours, plus the time required to perform sealing and tightness tests, additionally the sealed area of the leak becomes a sensitive area when piping or tools are lowered through it.

Use of epoxy resins. A variant of the previous method is the use of epoxy resins (Yufei Sun Et Al., 2019) that are injected over a plug, along the area where leaks occur, premixed with both, a catalyst for hardening and a reaction accelerator. The authors point out that this technology is ideal for conditions where the use of particles can cause bridging in channels or very closed fractures, gravel packing, small and microannular fractures; They also point out that once it penetrates the microspaces that form the leaks, a three-dimensional network is created that seals the system. Once cured, it is drilled through to open the production column again. Although its compression properties are good, its tension properties are not better, this limits its use to small to very small pore and channel sizes, larger Leak cavities can produce this type of stress making their use risky, particularly if differential pressures exist due to leaks.

Use of laser rays. Another type of hydrocarbon pipes that require repair are those that conduct hydrocarbons on the ocean floor, in extreme cold and heat, in places that are difficult to access and those exposed to microbiological corrosion; Asher et al. (2012) discuss this topic and in particular the potential for remote repair using laser beam cleaning/welding of hydrocarbon pipelines.

Production methods with water control. In some hydrocarbon wells, excessive water production becomes a big issue (Nasser H. Al-Azmi Et Al., 2017); in them, appropriate knowledge of the water production mechanism is particularly relevant to develop and apply efficient technologies, Nasser presents relatively simple solutions that include placing packers in the producing area, in such a way that the production of hydrocarbons trough the annular and canceled at the center, then, using one or more pumps the water is extracted through the surface.

Sealing fluids based on nanoparticles. These fluids have been designed (Todd Et Al., 2018) to cover the market for old wells or wells that have been decommissioned, but with high pressures in the annular space and with very small leaking holes in the TR less than 150.0 micrometers; The sealing effect is achieved when these fluids meet brines or cementation material in the porous areas. The authors present results from three wells where this technology has been successfully applied. Of course, these sealing fluids are limited to microporosities on large surfaces and do not consider larger porosities such as holes in the range of millimeters or even centimeters caused by corrosion and other agents.

Current exploration techniques allows us to know and precisely verify the areas where anomalies are found in production or casing pipes. This has also allowed the development of new production and casing pipe repair technologies that include composite patches, resins based sealing systems and other thermoactivated, hydro activated materials, or materials activated with pressure differentials; sealing methods have also been developed with preformed materials, and with the use of soft metals that can expand inside the TR or TP in full or partial contact with the interior wall. Other types of mechanical devices include those installed with anchors in the pipe being repaired, sealing the contact with devices inspired by packer technology. Each of these systems offers generalized or specific solutions to particular scenarios and presents advantages and limitations specific to its objectives and scope, which are reflected in their designs. Their limitations are related to repair equipment requirements, deployment systems, installation times, longevity of the technology, scope of the solution, since almost all of them are developed for pipe diameters greater than 114.3 mm (4.5 inches), efficiency and flexibility of the solution.

The present invention has overcome the limitations of the technologies described and provides the following advantages:

1. The technology of this invention is applicable to production pipes with nominal inside diameters in the range from 60.325 mm (2.375 inches), poundage of 8.633 kg/m (5.8 pounds/ft) to 114.3 mm (4.5 inches) and poundage of 18.755 kg/m (12.6 lbs/ft); As evidenced in the included practical example, there is no tool like the one of this invention designed for these diameters on the market.
2. It contributes to reducing, through closure or abandonment, the number of producing wells that present failures in their mechanical integrity manifested during the exploitation process.
3. Prevents contamination of water bodies due to fluid leaks through casing pipes. The practical example demonstrated that the packer isolation mechanism of this invention was efficient in isolating the flow within the tool from external pressures of up to 20.684 MPa (~3,000.00 psi), demonstrating the functionality of the Device (D).
4. This invention allows intervention of untapped low permeability producing intervals, which require fracturing, stimulation and evaluation, among other types of interventions.
5. It can be designed to accommodate pipe movements due to the different production loads that the well may experience throughout its productive life. The design of Device (D) includes a double point of rigid fixation, which both, longitudinally centers this device in the pipe and creates a redundant support system that safely supports the ascending and descending differential pressures; Test results reported with this device show that it supports up to 20.684 MPa (~3,000.00 psi), during anchoring and fixation tests.
6. The materials used in its manufacturing are chosen to achieve high functionality and efficiency for long periods of time; Device (D) manufactured with the proposed materials showed its ability to withstand the high pressures used and the induced stresses, as described below in the Example.
7. The installation of this device is carried out with a steel line, which significantly reduces downtime and production suspension. Installation and obtaining results of Device (D) of this invention required three hours, including preparations, compared to at least six hours up to 12 hours required by a repair team to perform the same operation.
8. Associated costs are significantly reduced using steel line for installation.
9. No waiting times are required to install two or more devices successively in a single well.
10. Delivery times, due to the design of Device (D), are short, in the range of four weeks.
11. The permissible operating temperature is in the region close to 120° C.

It is, therefore, an object of the present invention provides a system for restoring the mechanical integrity of production or casing pipes with diameters less than 114.3 mm (4.5 inches).

Another object of the present invention is to provide the petroleum industry with a novel device and methods that resolve quickly the sealing of leaks or punctures in tubing or casing at any length and can accommodate protrusions such as joint defects and similar geometric restrictions in the area to be isolated.

An additional object is to provide a device that is easily installed in few hours with steel line, using standard Fishing tool type connectors.

Another additional object is to provide a device that, due to its design and selection of manufacturing materials, provides continuous service for long periods of time.

These and other objects of the device of the present invention will be discussed later in greater detail.

PATENTS REFERENCED

[1]. Binggui Xu, Hongwei Yin, Huijuan Gui, Zhitong Liu, Mingjie Lv, Jianli Wang, Qiang Li, Peng Kang, Tao Jia, Xue Wang, Yi Tian, Aiguo Wang (2020) Mechanical and Hydraulic dual-effect expansion device for well drilling with expandable tubular technology." U.S. Pat. No. 10,641,067 B2, China National Petroleum Co., CNPC Engineering Technology R&D Company Limited, Beiging, CH. Dated on May 5, 2020.

[2]. Caccialupi, A., Allen, M., Benzie, S. (2018) "Metal Patch System," U.S. Pat. No. 10,132,141 B2, MOHAWK energy Ltd., Houston, TX US), dated on Nov. 20, 2018.

[3]. Filipov, A. G., Benzie, S. A., Caccialupi, A. (2020) "Casing Patch System" U.S. Pat. No. 10,837,264 B2, MOHAWK energy Ltd., Houston, TX US), dated on Nov. 17, 2020.

[4]. Gammill Clemens, J. (2017) "System and Method for Deploying a Casing Patch." U.S. Pat. No. 9,587,460 B2, Cesionario Halliburton Energy Services, Inc. Houston, TX (US), dated on Mar. 7, 2017.

[5]. Gammill Clemens, J. (2020) "Downhole Casing Patch." U.S. Pat. No. 10,612,349 B2, Cesionario Halliburton Energy Services, Inc. Houston, TX (US), dated on Mar. 7, 2017.

[6]. Mullins, F. (2016) "Apparatus and Method for setting a liner." U.S. Pat. No. 9,453,393 B2, Cesionario Seminole Services, LLC, The Woodlands, TX (US), dated on Sep. 27, 2016.

[7]. Toshikasu Igi (2016) "Long casing patch Method." U.S. Pat. No. 9,481,156 B2, Cesionario Kanto Natural Gas Development Co., LTD., Mobara-Shi, Japan.

[8]. Japanese patent No. JP200120653A without additional information.

BIBLIOGRAPHIC REFERENCES

Akisanya, A. R., Khan, F. U., Deans, W. F., Wood, P. (2011) "Cold hydraulic expansion of oil well tubulars." International Journal of Pressure Vessels and Piping 88(2011) 465-472.

Al-Dossary, A, F., Al-warthan, A., Al-Badran, M., Al-Ghamdi, I. S., Mutawaa, W. (2017) "The Ideal approach for casing leak repairs in Old wells." SPE-188478-MS, Proceedings of the Abu Dhabi International Petroleum Exhibition & Conference held in Abu Dhabi, UAE, 13-16 Nov. 2017.

Anderson, T. D., Kulkarni, M. G., Kumar, A., Macia, M. L., Fairchild, D. P., Bardi, F. (2011) "Pipeline Integrity and Rehabilitation Technology: An Operator's Perspective." Proceedings of the Twenty-first International Offshore and Polar Engineering Conference Maui, Hawaii, USA, June 19-24.

Ansari, A. A., Libdi, Z., Larsen, A. G. (2016) "Innovative Planning and Remediation Techniques for Restoring the Well Integrity by Curing High Annulus-B Pressure and Zonal Communication" IPTC-18894-MS, International Petroleum Technology Conference held in Bangkok, Thailand, 14-16 November.

Artificial Lift Systems (ALS), México Norte (N/A) "Manual Técnico para Sistemas Artificiales y Métodos de Producción aplicado para Pozos de Gas." In Spanish, Schlumberger, Carretera Reynosa Monterrey, México. Document found on Jul. 30, 2021 in the following website: https://www.academia.edu/31284860/Manual_T%C3%A9cnico_para_Sistemas_Artificiales_y_M%C3%A9todos_de_producci%C3%B3n_aplicado_para_Pozos_de_Gas.

Asher, S., Kumar, A., Fairchild, D., Nissley, N. (2012) "Investigating Remote Pipeline Repair using Laser Cleaning and Welding." Proceedings of the Twenty-second International Offshore and Polar Engineering Conference Rhodes, Greece, June 17-22.

Bailey, B., Crabtree, M., Tyrie, J., Elphick, J., Kuchuk, F., Romano, C., Roodhart, L. (2000) "Water Control." Oilfied Review, Spring 2000.

Carballo, A. D. E., Granados, A. E. J. (2014) "Reparaciones mayores y menores en pozos petroleros." Thesis in Spanish, Facultad de Ingenieria, UNAM, México.

De la Torre, R. E., Ramos, R. H., Jimenez y G. J. M: (2017) "Terminación y Reparación de Pozos Petrolíferos." In Spanish, Editorial Trillas, México.

Durongwattana, N., Toempromraj, W., Jedsadawaranon, P., Sompopsart, S. (2012) "Well Integrity Remediation—A Challenge for Swellable Technology." IPTC 15205. Proceedings of the International Petroleum Technology Conference held in Bangkok, Thailand, 7-9 February.

Forbes, C., Taggart, I. (1998) "Selective Isolation of Perforated Liners Using Casing Patches: Case Studies from North Sea Operations." IADC/SPE 39348. Proceedings of the 1998 IADC/SPE Drilling Conference held in Dallas, Texas 3-6 Mar. 1998.

Gorrara, A., Hazel, P., Tavendale, F., Louden, F (2005) "Development of a Gas-Tight External Casing Patch Using Direct Hydraulic Expansion of Standard Casing to Achieve a Permanent Load Bearing Connection." SPE/IADC 92583, Proceedings of the SPE/IADC Drilling Conference held in Amsterdam, The Netherlands, 23-25 Feb. 2005.

Herrera, H. J. (2020) "Ingenieria de la perforación de pozos de petróleo y gas. Vol. III Sistemas básicos y procesos de los equipos de perforación." In Spanish, Laboratorio de Innovación en Tecnologías Mineras, Escuela Técnica Superior de Ingenieros de Minas y Energia. Universidad Politécnica de Madrid, Madrid, España.

Hill, D., Ertekin, A., Sridhar, A. N., Scott, C. (2009) "Performance of composite materials in corrosive conditions: cathodic disbondment of composite materials and modeling of a composite repair patch for pipelines" Paper 09329, Proceedings of NACE International Corrosion Conference & Expo.

Ho Yin Yap, Leong Hing Chua, Fidelis Sipangkui, Brian Rayner, B., Peng Yoke Low, Bato Connie (2021) "Innovative Remediation Techniques for Restoring Well Integrity with Coil Tubing Patch." SPE/IADC-202177-MS, SPE/IADC Middle East Drilling Technology Conference and Exhibition, Abu Dhabi, UAE, 25-27 May 2021.

IADC (2005) "Expandable technology enables casing repairs." International Association of Drilling Contractors, January-February issue.

Innes, G., Morgan, Q., Macarthur, A., et al. (2005) "Next Generation Expandable Completion Systems." SPE/IADC 97281.

Johns, J. E., Cary, D. N., Dethlefs, J. C., Ellis, B. C., McConnell, M. L. Schwartz, G. L. (2007) "Locating and Repairing Casing Leaks With Tubing in Place-Ultrasonic Logging and Pressure-Activated Sealant Methods." SPE 108195, Proceedings of the Offshore Europe 2007 held in Aberdeen, Scotland, U. K., 4-7 Sep. 2007.

Julian, J. Y., Cahalane, T. W., Cismoski, D. A., Burton, J., Savage, E. L. (2006) "Rigless Tubing Repair Using Permanent and Retrievable Patches at Prudhoe Bay, Alaska." SPE 104055, Proceedings of the First International Oil Conference and Exhibition in Mexico held in Cancun, Mexico, 31 Aug.-2 Sep. 2006.

Karev, V., Kovalenko, Y., Ustinov, K. (2020) "Geomechanics of Oil and Gas Wells." Springer; Advances in Oil and Gas Exploration & Production. Springer Nature Switzerland AG.

Li Tao, Shan Gao, Qiang Chen, Yiliang Li, Weiye Han, Xiuling Bi, Qiang Sun (2013) "Innovative Design of the Solid Expandable Tubular to Patch the Casing: Area Below the Previously Installed Expandable Tubular" IPTC 16429, International Petroleum Technology Conference, Beiging, China, Match, 26-28.

Li Tao (2015) "Solid expandable tubular patching technique for high-temperature and high-pressure casing damaged wells." Petroleum Exploration and Development, Volume 42, Issue 3, June 2015.

Neely, J. D. (1985) "The use of casing patches to improve workover success rates." SPE13996. Proceedings of the Offshore Europe 85 Conference in Conjunction with the Society of Petroleum engineers of AIME held in Abeerden, 10-13 Sep. 1985.

Mackenzie, G., McLelland, A., Carragher, P., Fulks, J., Mason, D. (2022) "Innovative and Collaborative Well Intervention Solution Restores Well Integrity to Compromised Completion." SPE-209036-MS, Proceedings of the SPE/ICoTA Well Intervention Conference and Exhibition, The Woodlands, Texas, USA, 22-23 Mar. 2022.

Noble, L., Rees, H., Langnes, T., Thiruvenkatanathan, P. (2021) "Using Distributed Fibre Optic Sensing to Recover Well Integrity and Restore Production." SPE-204450-MS, Proceedings of the e SPE/ICoTA Well Intervention Conference and Exhibition to be held virtually on 22-25 Mar. 2021. Official proceedings were published online on 15 Mar. 2021.

Plaxton, B., Pehlke, T., Baxter, D., Crockett, M., Kaiser, T. (2018) "SAGD Production Casing Failure Diagnosis and Repair." SPE-193362-MS, Proceedings of the SPE Thermal Well Integrity and Design Symposium held in Banff, Alberta, Canada, 27-29 Nov. 2018.

Qamar, S. Z., Akhtar, M., Pervez, T. (2021) "Swelling Elastomer Applications in Petroleum Drilling and Development-Applications, Performance Analysis, and Material Modeling." IntechOpen Limited, London, UK. Document found on Jul. 25, 2022 in the website: https://www.intechopen.com/books/10159.

Rodenboog, C. (2001) "A novel approach for tubing repair in a HPHT well." SPE 68417, Proceedings of the SPE/ICoTA Coiled Tubing Roundtable held in Houston, Texas, 7-8 Mar. 2001.

Sadigov, T., Thiruvenkatanathan, P., Sheydayev, A. (2017) "Application of Distributed Acoustic Sensing DAS Technology in Identification and Remediation of Sand Producing Zones in OHGP Completion." SPE-188991-MS, Proceedings of the SPE Annual Caspian Technical Conference and Exhibition held in Baku, Azerbaijan, 1-3 Nov. 2017.

Saltel, B., Gonzalez, L., Trevor McIntosh, T., Weems, M. (2015) "Restoring Casing Integrity Using an Expandable Steel Patch Prior to Drilling Ahead With Minimal Reduction of Next Hole Size." SPE-174524-MS. Proceedings of the SPE Well Integrity Symposium held in Galveston, Texas, USA, 2-3 June.

Short, J. A. (1981) "Fishing and Casing Repair." PennWell Publishing Company, Tulsa, Oklahoma, US.

Smalley, M. T., Rae, G. (2001) "Use of Corrugated Material Technology to Provide Low-Risk Solution to Repair Connector Leakage on the Captain Field, UKCS." IADC/SPE 7288, Proceedings of the IADC/SPE Middle East Drilling Technology held in Bahrain, 22-24 Oct. 2001.

Styler, J. W., Al-Suwailem, S. S., Akhnoukh, R. L., Leighton J. R. (2001) "A Unique Rigless Casing Leak Repair, Ghawar Field, Saudi Arabia," SPE 68129, SPE Middle East Oil Show, Bahrain, 17-20 March. Citado por Karen Bybee, *J. Pet. Technol.* 53 (06): 28-29. Paper Number: SPE-0601-0028-JPT.

Todd, L., Cleveland, M., Docherty, K., Reid, J., Cowan, K., Yohe, C. (2018) "Big Problem-Small Solution: Nanotechnology-Based Sealing Fluid." SPE-191577-MS, Proceedings of the 2018 SPE Annual Technical Conference and Exhibition held in Dallas, Texas, 24-26 Sep. 2018.

TTS, "Casing Patch Specifications". Webpage found on Nov. 12, 2022, in the following internet address: http://www.thrutubingsystems.com/intervention-products-and-services.php?product=/x-span-tubing-and-casing-patches/casing-patch-specifications.

Weatherford (2016) "HOMCO Cassing Patch. Restoring casing integrity with a permanent Steel seal." Weatherford Co. Webpage found on Nov. 14, 2022, in the following internet address: https://www.weatherford.com/documents/brochure/products-and-services/intervention-and-abandonment/homco-casing-patch/.

Xu Lin, Jiang Mengchen, Xu Jie, Xu Mingbiao, Meng Shuang, Wang Dongxu (2020) "Design and plugging property of composite pressure activated sealant." Natural Gas Industry B 7, pp. 557-565.

Yufei Sun, Anyu Fang, Wenmin Fan, Zhiyong Chen, and Sheming Liu, Yang Wang, Li Li, Xiaoming Zhang, Chunlong Luo (2019) "Applying Epoxy Resin Technology on Remediation for 3.5 in. Casing Leak: Case Study, South Sulige Gas Field." SPE-196503-MS, Proceedings of the SPE/IATMI Asia Pacific Oil & Gas Conference and Exhibition held in Bali, Indonesia, 29-31 Oct. 2019.

BRIEF DESCRIPTION OF THE DRAWINGS OF THE INVENTION

Aimed to provide clarity in the description of the system for the restoration of the mechanical integrity of casing or production pipes of reduced diameter, object of the present invention, reference will be made to the accompanying drawings, without limiting the scope of the present invention:

FIG. 1 exhibits frequent anomalies in both, production and casing pipes, which illustrate: I. Intentionally made perforations in the pipes and II. Unintentional damage to pipes.

FIG. 2 presents the process of installing a patch showing (I) A damaged pipe with an illustrative longitudinal section, (II) Pipe with the pneumatic device, also on it an expandable patch whose tensile strength material can be a fiberglass framework or carbon, embedded in a layer of resin curable with water or heat, it can also be a longitudinally cut section that has been given the shape of a helicoid, (III) Expanded pneumatic device and expanded patch in contact with the inner face of the damaged pipe and (IV) Patch placed in the damaged area.

FIG. 3 illustrates an alternative to patch placement, where a mechanical restoring force has been induced by means of a longitudinal cut and post-forming.

FIG. 4 shows the installation process of a hydro-expandable patch, showing: a damaged pipe in an illustrative longitudinal section (4-*n*), a damaged pipe with smaller diameter pipe and on top of it an expandable patch flooded in a saturated saline working liquid to minimize the expansion speed during its placement at the point of the damaged area (4-*o*), and damaged pipe with smaller diameter pipe and an expanded patch on top of it, flooded in a non-saline working liquid to accelerate the expansion speed of the patch in the damaged area (4-*p*).

FIG. 5 exemplifies four different device-to-pipe anchoring mechanisms: a) Anchoring by friction (barrel expansion), b) anchoring with wedges, c) variant of anchoring with wedges and inserts made of more resistant metal, such as carbide. tungsten and d) anchoring by mechanical interference.

FIG. 6 illustrates device D showing a partial longitudinal section.

FIG. 7 presents the overall view of the Device (D)

FIG. 8 shows the first section (I) in a longitudinal section, which includes the lower mechanical anchor with the central body or core (1).

FIG. 9 reveals the second section (II) in a longitudinal section, which includes the Wedge holder sleeve (6), the Ring (7), the Ratchet (8), the Sealing cylinder (9), the Seal (10), the Nose (11), Captive Sleeve (12), Lower Packer Core (13) and Bolt (14).

FIG. 10 shows the third section (III) with the upper Connector that facilitates the connection between the Second section (II) and the Fourth Section (IV).

FIG. 11 presents the fourth section (IV) in a longitudinal section that exhibits a typical Shirt (19).

FIG. 12 exposes the Fifth section (V) in a longitudinal section, with the Fishing tool Connector that facilitates the connection between the Fourth Section (IV) and the Sixth section (VI).

FIG. 13 shows the Sixth section (VI) in a longitudinal section, which includes the lower mechanical anchor with the central body or Core-S (23), Ring-S (24), Wedges-S (25), Wedge Holder-S (26) and S-conic section (27).

FIG. 14 presents the Seventh section (II) in longitudinal section, which includes the Wedge Sleeve-S (28), the Ring-S (29), the Ratchet-S (30), the Sealing Cylinder-S (31), S-Seal (32), S-Nose (33), S-Captive Sleeve (34), S-Packer Core (35), and Bolt-S (36).

Figure 20:
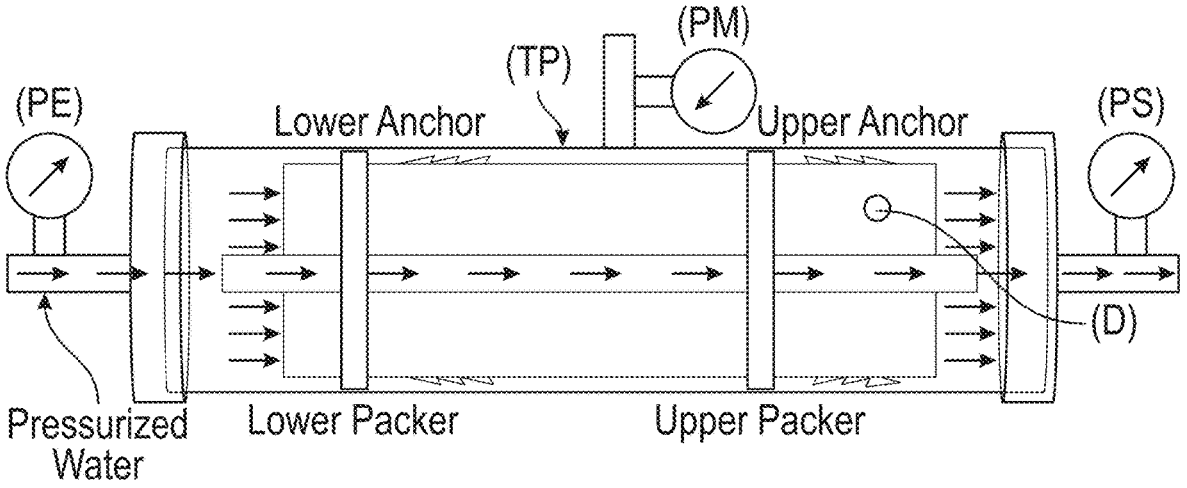

FIG. 20 presents the configuration diagram of the Device (D) with the inlet (PE), intermediate (PI) and outlet (PS) pressure gauges during the tightness test.

Figure 21:
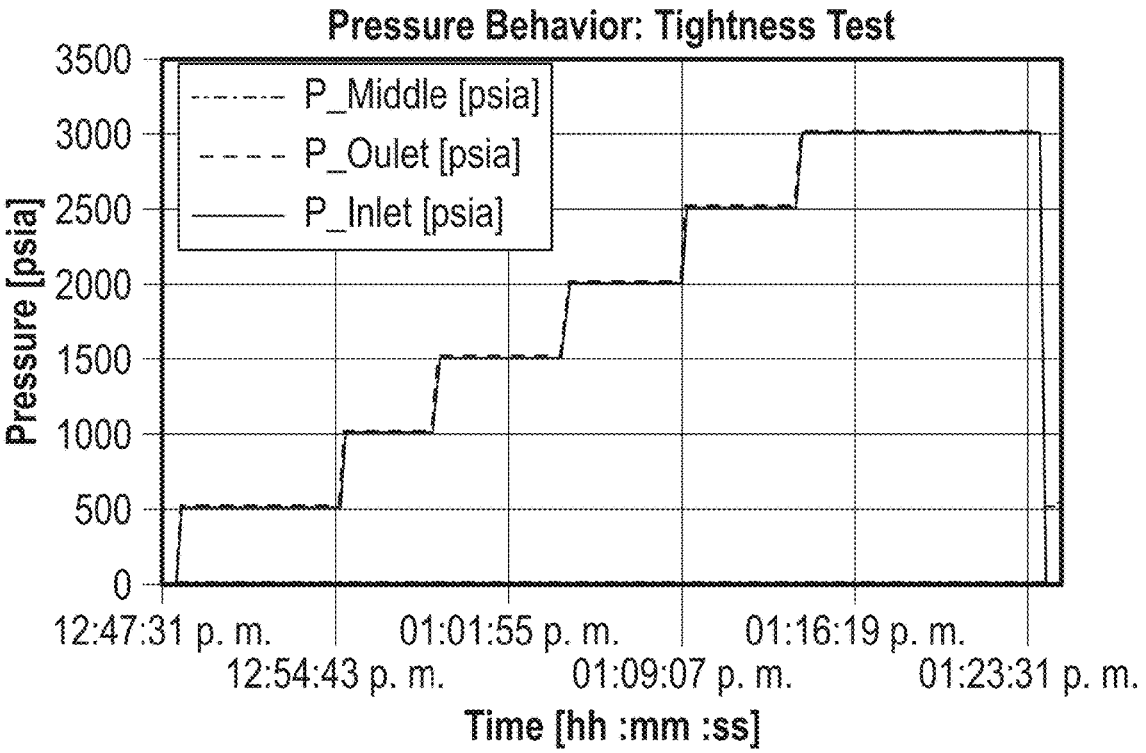

FIG. 21 reveals the pressure recording in the inlet (PE), intermediate (PI) and outlet (PS) manometers during the tightness test.

Figure 22:
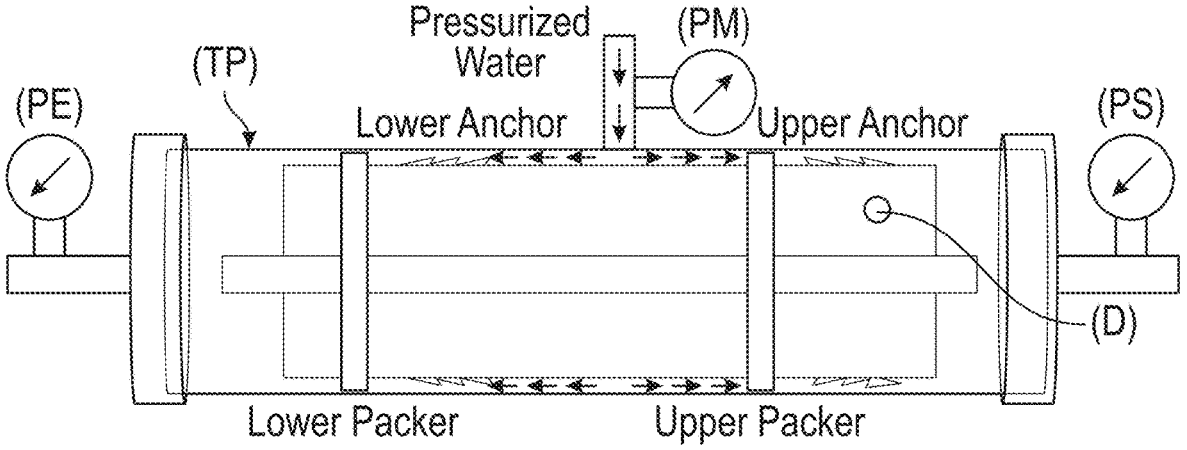

FIG. 22 shows the configuration diagram of the Device (D) with the inlet (PE), intermediate (PI) and outlet (PS) pressure gauges during the differential pressure test.

Figure 23:
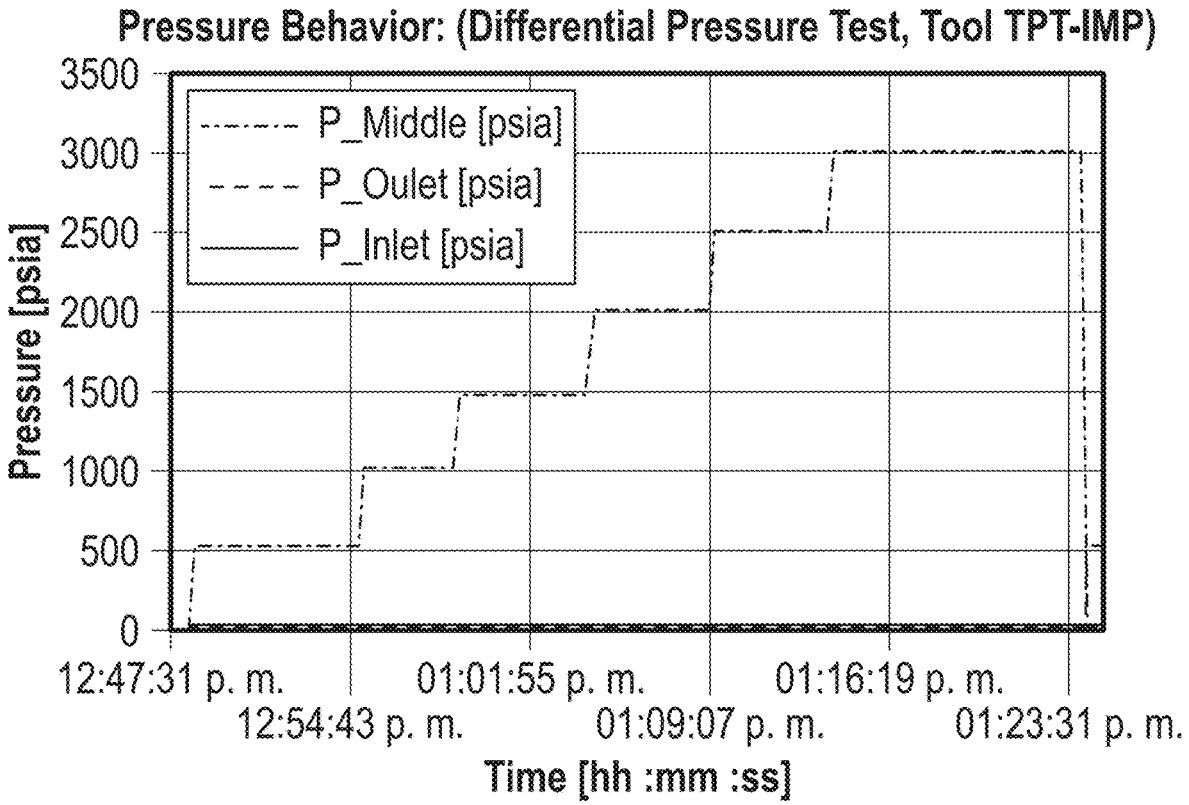

FIG. 23 shows the pressure recording in the inlet (PE), intermediate (PI) and outlet (PS) manometers during the differential pressure test.

DETAILED DESCRIPTION OF THE INVENTION

The present invention relates to a technology whose objective is to restore the mechanical integrity of casing or production pipes in hydrocarbon producing wells that have anomalies in their wall, these include holes, perforations or divisions; This technology includes a Device (D) that is installed in a conventional operation with a slickline unit, avoiding the use of repair equipment and minimizing the impact on the components of the integral hydrocarbon production system, and is placed inside a well to isolate areas of tubing or casing having abnormalities; simultaneously allows the flow of hydrocarbons or other fluids along its longitudinal axis, at pressures of up to 34.474 MPa (~5,000.00 psi); It also includes a method for diagnosis, design and potential effectiveness of the Device in a well, a method for the Device (D) installation in the well, a method for verifying its effectiveness already installed, and a method for its recovery to the surface.

Figure 8:
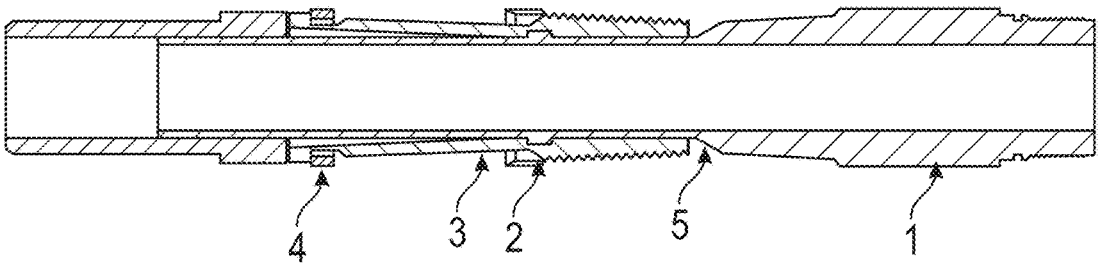

This assembled Device has a cylindrical shape, made up of seven longitudinally hollow cylindrical sections, assembled one on top of another along its longitudinal axis (FIG. 7), with the First section (I) being the lowest and the Seventh section (VII) the uppermost; It is also characterized because gases and liquids, hereinafter called fluids, enter in intermittent flow configurations, and flow along the Device (D) through its hollow section; the Device (D) has a diameter in its internal hollow cross section that is designed according to the nominal diameter of the production/casing pipe where it will be installed; This varies in the range of 60.325 mm to 114.300 mm (2.375 inches to 4.500 inches). The seven sections are described below:

First section (I). This section includes a lower mechanical anchor, which has expandable wedges, hereinafter called wedges [number (3) of FIG. 8]; this lower mechanical Anchor has a mechanical system that helps fix the Device inside the production pipe, in its lower part by means of the Wedges. Fixation is performed by mechanical interference between the production tubing or casing and the Anchor Wedges. The lower mechanical Anchor, illustrated in FIG. 8, is formed by a central Body or Core (1) that partially supports the Wedges, these have a device called Wedge Holder (4) that holds them concentric to the Core (1); This Core allows the linear relative movement of the Wedges-Wedge Holder assembly, said assembly is held together by a mechanical interference that restricts the linear movement between them but allows its radial movement (Wedge opening) which is limited by a Ring (2), fixed to the Core using screws. To achieve the opening of the Wedges, the Core has a conical Section (5) that, in addition to generating the opening of the Wedges, supports the mechanical interference achieved with the production or casing pipe; both, the Core and Wedge Holder are made of materials that withstand stresses of 655.002 MPa (~95,000.0 psi), preferably AISI 4140T, and the Wedges, due to their mechanical interference work, must, in addition to withstanding high tensions, resist simultaneously shear and compression forces, which is why special hardening treatments are used on them, therefore materials such as AISI 4140 with a tempering treatment may be used; The Ring, due to its exposure to acidic environments, requires that it be specified using resistant materials such as Stainless Steel 316. The uppermost part of the First section (I) is rigidly and hermetically connected to the Second section (II) by means of a truncated thread located in the Core (1).

Figure 9:
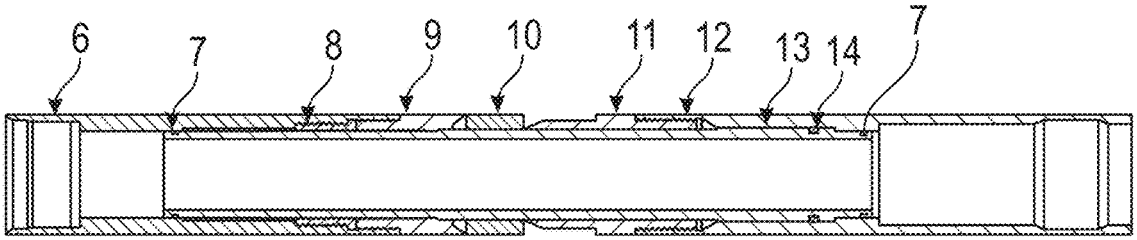

Second section (II). This section (FIG. 9), includes a mechanical system called the Lower Packer that, together with the upper Packer (described below), allows generating a hermetic seal between the Device (D) and the interior of the production pipe or casing; sealing is performed by mechanical interference between a deforming polymer ring, also called Seal (10), during installation of Device (D) at the inner wall of the production tubing or casing; The mechanical system of the Second section (II) is made up of a central element called Lower Packer Core (13) which has the function of allowing the linear movement of the following elements: Wedge holder sleeve (6), Ratchet (8), Sealing cylinder (9), Seal (10), Nose (11) and Captive sleeve (12), in addition to housing the elements to generate internal tightness called Rings, and a release element called Bolt (14); The Wedge holder sleeve (6), which is located in the lower part of the Second section (II), allows the union of this section with the upper part of the First section (I) and internally houses the Ratchet (8) in such a way that there is no relative movement between elements (6) and (8). The lower Packer is joined to the lower Mechanical Anchor by a truncated threaded connection. In its upper part, the wedge holder sleeve (6) connects with the sealing cylinder (9). The Sealing cylinder (9) is a physical barrier to support the Seal (10) as well as a guide to obtain the desired deformation of the Seal (10). The Nose (11) generates the radial expansion of the Seal (10) because of its linear movement on the Lower Packer Core (13); In its upper part, the Nose (11) connects with the Captive sleeve (12) through a preferably threaded connection. The Captive sleeve (12) includes in its body a housing for the Bolt (14), and in its upper part another housing for its placement/retrieval using a Fishing tool, preferably GS type; The Bolt (14) has a mechanical fuse function to recover the packer to the surface when it breaks; To break the Bolt (14), a Fishing tool, preferably GS type, is coupled to the Captive Sleeve (12) and through an upward impact a cutting effect is generated on the Bolt (14) due to the relative movement that exists with of the Lower Packer Core packer core (13).

The fixation of the lower Packer is carried out as follows: Both, the Wedge holder sleeve (6) and the Sealing cylinder (9) are fixed; then, by striking the upper part of the Captive Sleeve (12), a downward linear movement is generated that is transferred to the Core of the lower packer (13), to the Nose (11) and to the Seal (10), causing the tool to reduce in length and expand the Seal (10). To prevent the tool from returning to its initial length, the Ratchet (8) prevents the Packer from expanding after being compressed.

The recovery of the First and Second sections is carried out in the following way: Using a Fishing tool, preferably GS type, the Captive Sleeve (12) is hit upwards, this generates a shear force in the Bolt (14) in such a way that it breaks, which allows the upward linear movement of the Nose (11), as well as the contraction of the Seal (10); due to the forces to which they will be subjected, the Wedge holder Sleeve (6), the Ratchet (8), the Sealing cylinder (9), the Nose (11), the Captive sleeve (12) and the Lower Packer Core (13) are made of materials that withstand stresses of 655.002 MPa (~95,000.0 psi), preferably AISI 4140T steel, the Bolt (14) preferably made of SAE 64 bronze, and the Ring (7) and the Seal (10) made of materials resistant to oils, acids, abrasion, water vapor and heat, preferably Viton™ Fluoroelastomers. The Second section (II), in its upper part, is joined to the Third section (III) by means of a seal type union with the Upper Connector, where the seal generating elements are chevrons, as indicated next.

Figure 10:
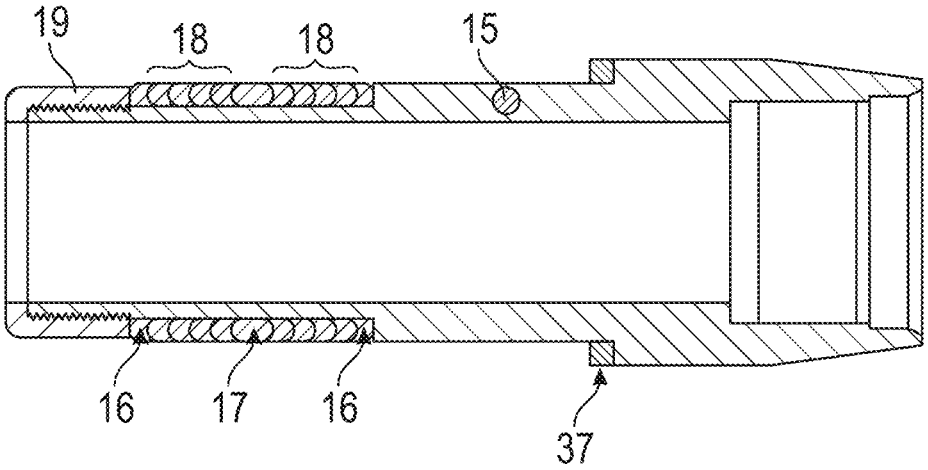

Third section (III). This section includes a mechanical system called Upper Connector (FIG. 10) whose objective is to allow a rigid and hermetic connection between the Packer of the Second section (II) and the Liners of the Fourth section (IV) described below. The connection between the Third section at its upper end and the Fourth section (IV) at its lower end is by means of a male/female threaded connection; The connection between the Third section (III) and the Second section (II) is mechanical interference due to friction between the internal wall of the Second section and the V-Seals of the Third section, inserting the Threaded cap (19) of the Third section at the uppermost end of the Second section; The length of the Third section that penetrates the Second section can be designed to accommodate the movements of the pipe due to the different production loads that the well may experience throughout its productive life, by means of an elastomeric ring. (37); The upper Connector has a central space called Core for seals (15); It also incorporates a threaded connection at its lower end and a Chevron type connection in its middle part; the Core for seals houses at least two Rings (16), at least one Middle Ring (17) and a plurality of V-Seals (18) preferably Chevron type, preferably between six and twelve V-seals placed adjacent to each other, which are kept without linear relative movement with respect to the Core for seals (15) through the Screw Cap; both, the Core for seals (15) and the Screw Cap (19) are made of materials that withstand stresses of 655.002 MPa (~95,000.0 psi), preferably AISI 4140T, and the Rings (16), Middle Rings (17) and V-Seals (18) due to their exposure to oils, acids, abrasion, water vapor and heat, are made of materials resistant to these agents, preferably Viton™ Fluoroelastomers.

Figure 1:
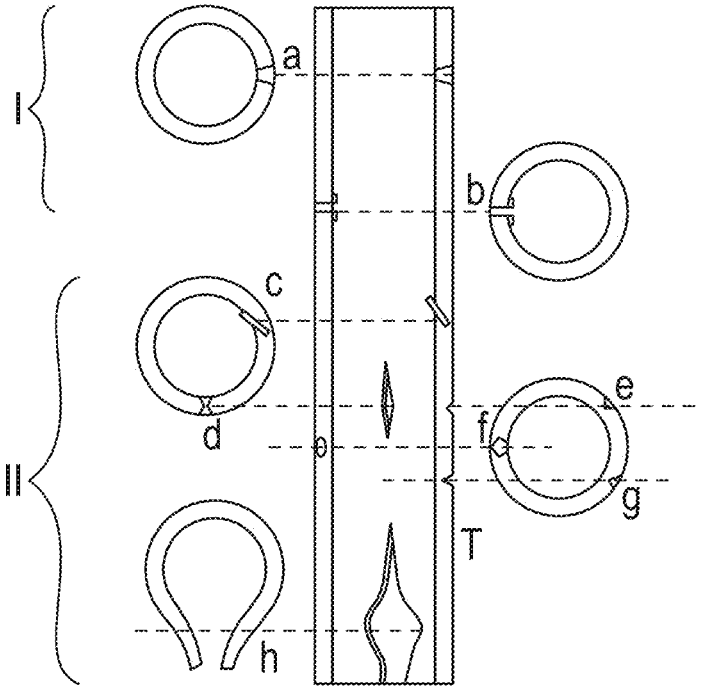
Figure 2:
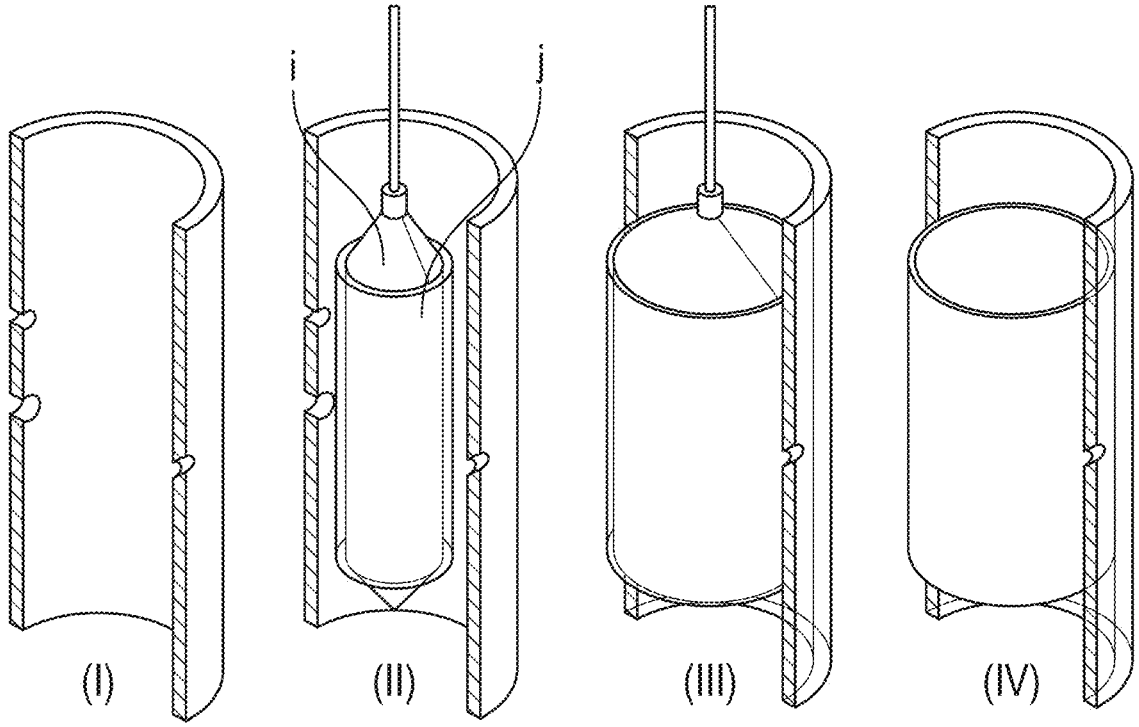
Figure 3:
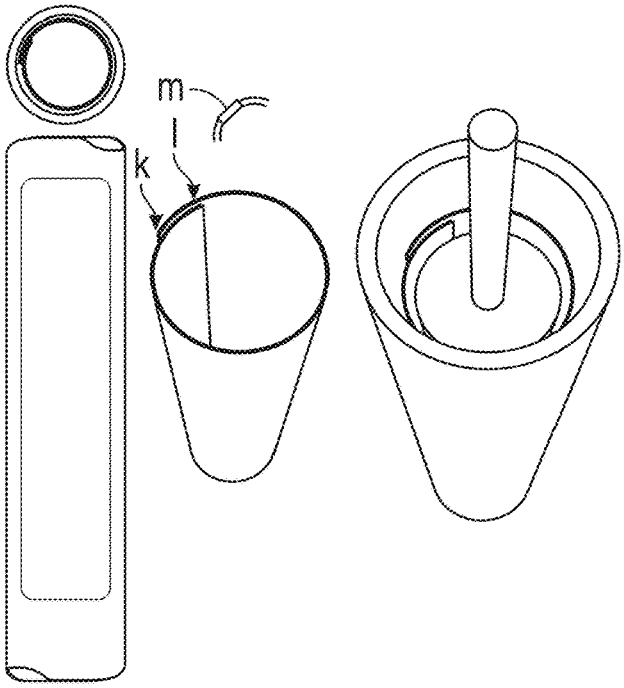
Figure 4:
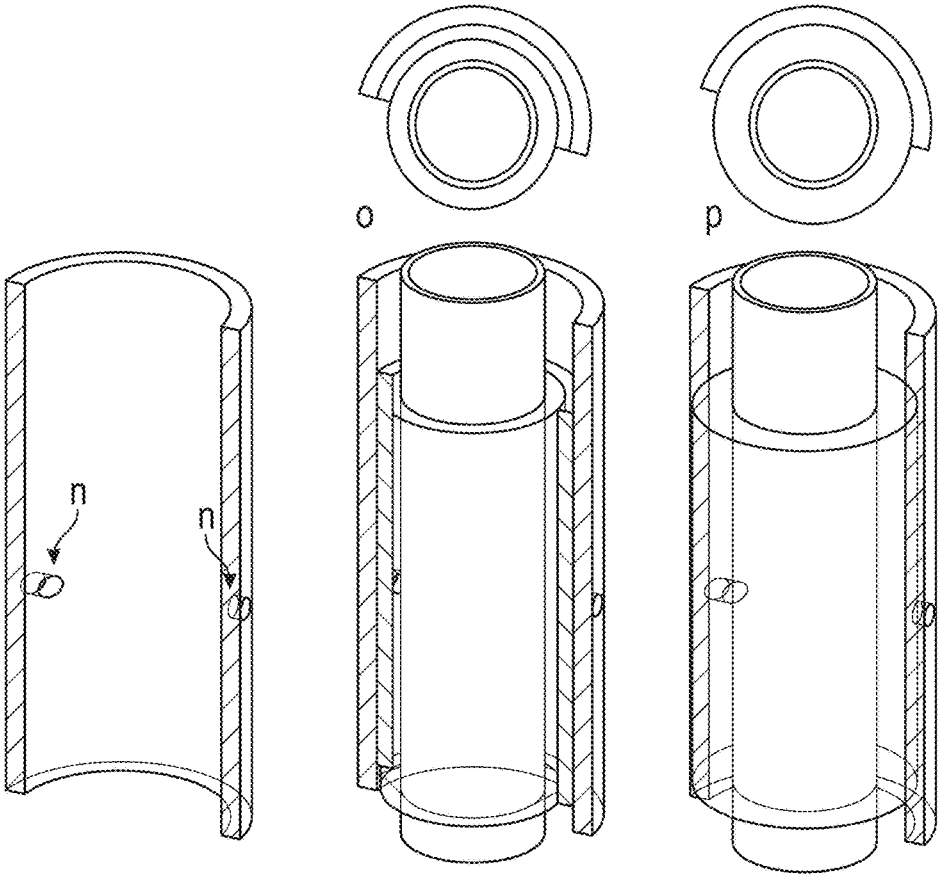
Figure 5A:
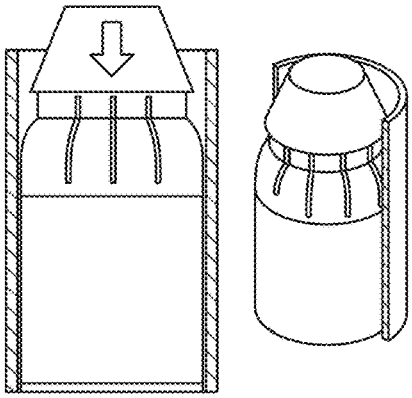
FIG. 5A (Prior Art)
Figure 5B:
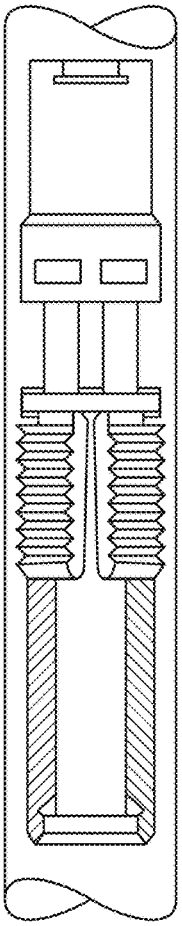
FIG. 5B (Prior Art)
Figure 5C:
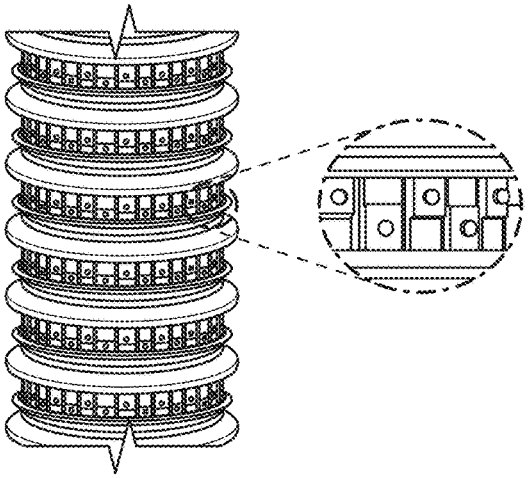
FIG. 5C (Prior Art)
Figure 7:
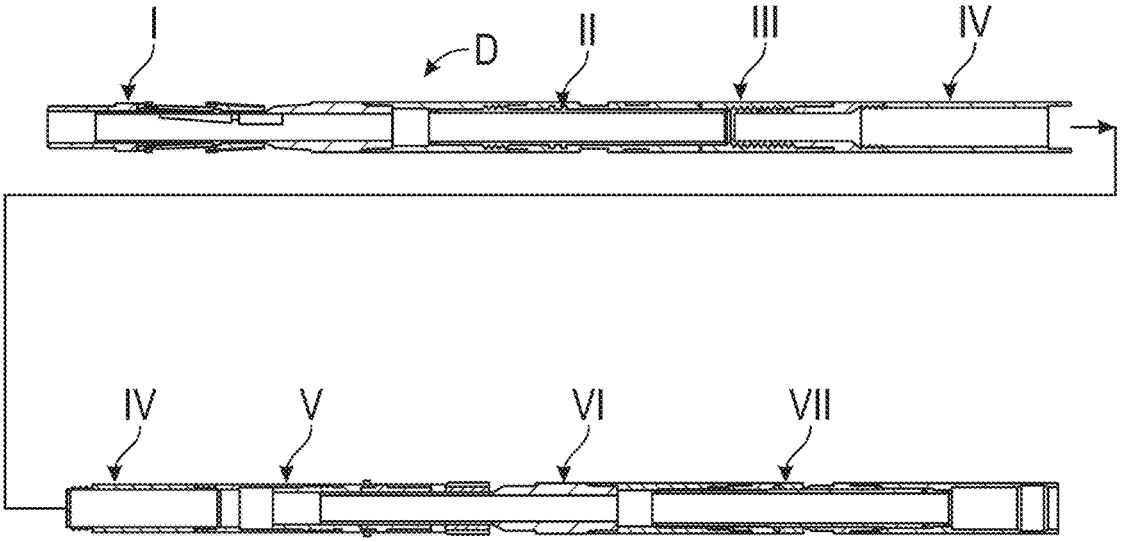
Figure 11:
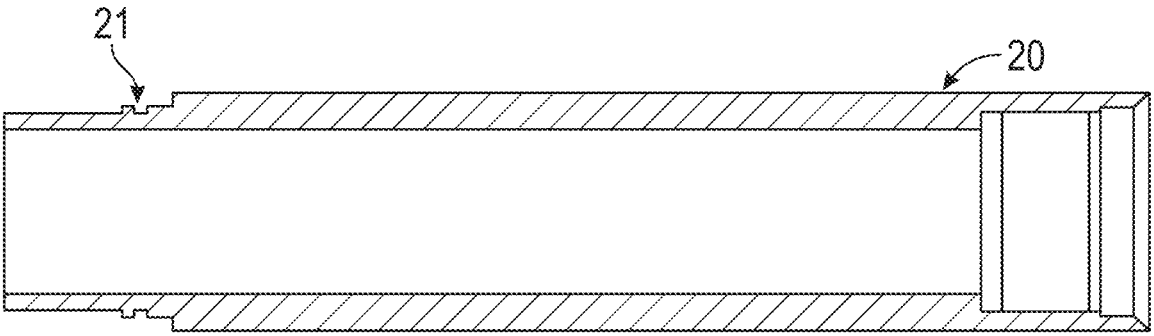

Fourth section (IV). This section (FIG. 11) includes a plurality of longitudinally hollow cylindrical mechanical elements, connected to each other at their ends in a rigid and hermetic manner, called Sleeves (20), whose objective is to generate a space in height and diameter to isolate a production pipe or casing with anomalies in its wall or unions, supported by the packers of the Second and Seventh sections; FIG. 7 shows two of them (Fourth Section, IV) and FIG. 11 shows the details of one of the sleeves (20) in a longitudinal section; the length of each sleeve is preferably 3,048 m (ten feet); Each Sleeve (20) in its lower part has a male threaded connection which connects to the next successive one with a female threaded connection; The lowermost sleeve, at its lower end is connected to the Third section (III) by means of a male threaded connection and at its uppermost end with the next sleeve with a female threaded connection; The uppermost sleeve at its uppermost end connects to the Fifth section (V) with a female threaded connection. The connection between two successive sleeves includes an O-ring named Seal-A (21); the sleeves (20) for their exposure to great stresses are made of materials that withstand stresses of 655.002 MPa (~95,000.0 psi), preferably AISI 4140T; the Seals-A (21) O-ring, due to their exposure to oils, acids, abrasion, water vapor and heat, are made of materials resistant to these agents, preferably Viton™ Fluoroelastomers.

Figure 12:
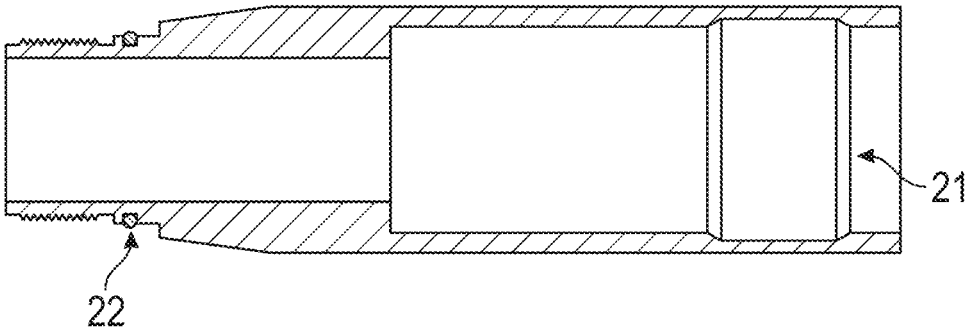

Fifth section (V). This section (FIG. 12) includes a Fishing tool Connector, which allows the rigid and hermetic connection between the uppermost sleeve of the Fourth section (IV) and the upper mechanical anchor of the Sixth section (VI), and consists of a cylindrical mechanical element, longitudinally hollow, which has in its upper part a fishing tool connection, preferably GS type (21-*b*), with a housing for an O-ring seal (22); the fishing tool connector allows the mechanical and hermetic connection with the Upper mechanical anchor of the Sixth section (VI), for placement/retrieval; The Fishing tool Connector is made of materials that withstand stresses of 655.002 MPa (~95,000.0 psi), preferably AISI 4140T; The O-ring, due to its exposure to oils, acids, abrasion, water vapor and heat, is made of materials resistant to these agents, preferably Viton™ Fluoroelastomers.

Figure 13:
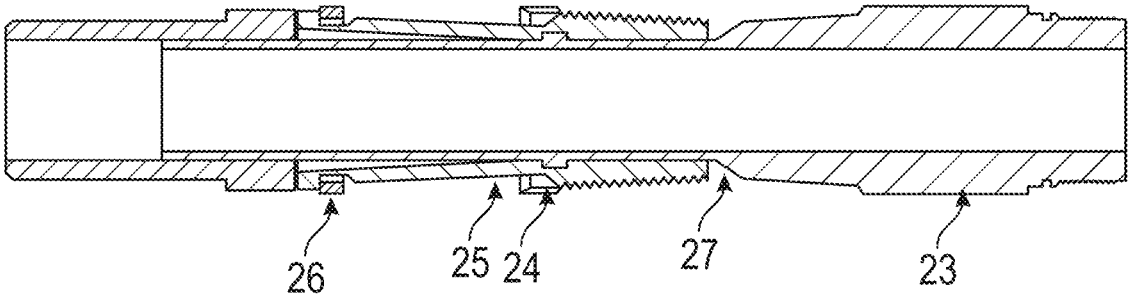

Sixth section (VI). This section (FIG. 13), similar to the Lower Mechanical Anchor, includes an Upper Mechanical Anchor which has a mechanical system to fix the Device (D) inside the production pipe or casing in its upper part by means of expandable wedges, hereinafter called Wedges-S. Fixation is performed by mechanical interference between the production tubing or casing and the Wedges-S of the upper mechanical anchor. The upper mechanical Anchor, illustrated in FIG. 13, is formed by a central Body or Core-S (23) that partially supports the Wedges-S (25), these have a device called Wedge Holder-S (26) that holds them, concentric to the Core-S; the Core-S allows the relative linear movement of the Wedges-S/Wedge Holders-S assembly, said assembly is held together by means of a mechanical interference that restricts the linear movement between them but allows its radial movement (opening of Wedges-S) that It is limited by an Ring-S (24) fixed to the Core with screws. To achieve the opening of the Wedges-S, the Core-S has an conical Section-S (27) that, in addition to generating the opening of the Wedges-S, supports the mechanical interference achieved with the production pipe or coating; The Core-S (23) and Wedge holder-S (26) are fabricated of materials that support tensions of 655.002 MPa (~95,000.0 psi), preferably AISI 4140T, and the Wedges-S (25) due to their mechanical interference work, must, in addition to withstanding high tensions, be resistant to shear stresses, which is why they are exposed to special hardening treatments; therefore, materials such as AISI 4140 with a tempering treatment are preferably used for their manufacture; The Ring-S, due to its exposure to acidic environments, requires that it be specified using resistant materials such as Stainless Steel 316. The uppermost part of this section is rigidly and hermetically connected to the Seventh section (VII) by means of a male/female thread and an o-ring to provide internal tightness.

Figure 14:
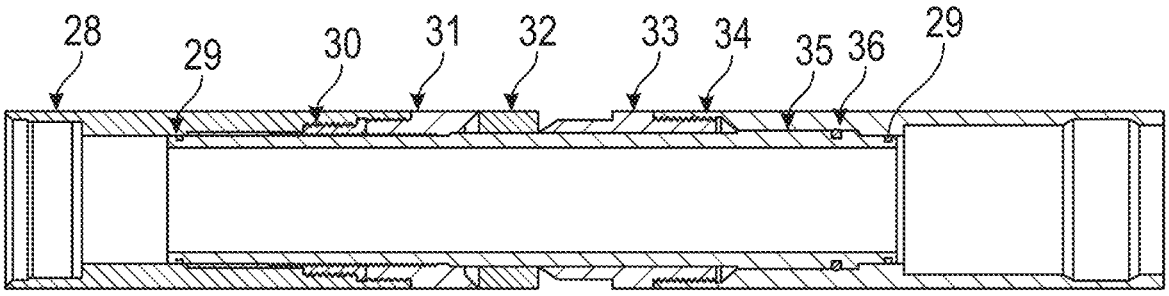

Seventh section (VII). This section (FIG. 14), includes a mechanical system called Upper Packer that, together with the Lower Packer, allows generating an airtight seal between the Device (D) and the interior of the production/casing pipe with anomalies in its wall and/or joints; sealing is performed by mechanical interference between a deforming polymer, also called Seal-S (32), during the installation of Device D and the inner wall of the production tubing (FIG. 14); The mechanical system of the Seventh section (VII) is made up of a central element called the Upper Packer Core-S (35), which has the function of allowing the linear movement of the following elements: Wedge holder sleeve-S (28), Ratchet-S (30), tightness cylinder-S (31), seal-S (32), nose-S (33) and captive sleeve-S (34), in addition to housing the elements to generate internal tightness called Orings-S, and a release element called Bolt-S (36); The wedge-holder sleeve-S (28), which is located in the lower part of the Seventh section (VII), allows the union of this with the upper part of the Sixth section (VI) and internally houses the Ratchet-S (30) in such a way that there is no relative movement between them. In its upper part, the Wedge-holder Sleeve-S (28) connects with the Tightness cylinder-S (31). The Tightness cylinder-S (31) represents a physical barrier to support the Seal-S (32), as well as a guide to obtain the desired deformation of the Seal-S (32). The Nose-S (33) generates the radial expansion of the Seal-S (32) because of its linear movement on the Upper Packer Core-S (35); The Nose-S (33) in its upper part is connected to the Captive Sleeve-S (34) by means of a preferably threaded connection. The Captive Sleeve-S (34) includes in its body a housing for the Bolt-S (36), and in its upper part another housing for its placement/retrieval by means of a Fishing tool, preferably GS type; the Bolt-S (36) has a mechanical fuse function to recover both, the upper packer and Anchor to the surface when it breaks; To break the Bolt-S (36), a Fishing tool, preferably GS, is coupled to the Captive Sleeve-S (34) and through an upward impact a shear effect is generated on the Bolt-S (36) due to the relative movement that exists with the Upper Packer Core-S (35). The anchoring is carried out in the following way: The Wedge holder Sleeve-S (28) and the Tightness Cylinder-S (31) are fixed; by striking the upper part of the Captive Sleeve-S (34), a downward linear movement is generated that is transferred simultaneously to the Upper Packer Core-S (35), to the Nose-S (33) and to the Seal-S (32), causing the Device (D) to reduce in length and expand the Seal-S (32). To prevent this section from recovering its initial length, the Ratchet-S (30) prevents the Upper Packer from expanding after being compressed.

Recovery of this section is carried out in the following way: using a Fishing tool, preferably GS type, the Captive Sleeve-S (34) is hit upwards, this generates a shear force in the Bolt-S (36) in such a way that it breaks, which simultaneously allows the upward linear movement of the Nose-S (33), as well as the contraction of the Seal-S (32); because of the stresses to which they will be subjected, the Wedge holder sleeve-S (28), the Ratchet-S (30), the Tightness Cylinder-S (31), the Nose-S (33), the Captive Sleeve-S (34) and the Upper Packer Core-S (35) are made of materials that withstand stresses of 655.002 MPa (~95,000.0 psi), preferably AISI 4140T, Bolt-S (36) preferably made of SAE 64 bronze, and both, the Ring-S (29) and the Seal-S (32) are manufactured from materials resistant to oils, acids, abrasion, water vapor and heat, preferably Viton™ Fluoroelastomers. The Seventh section (VII), in its upper part, has a Fishing tool housing, preferably GS type, for its placement and extraction, and is joined to the Sixth section (VI) by means of a truncated thread.

Method for the diagnosis, design and potential effectiveness of the Device in a well. The evaluation of the applicability of the Device (D) in a well requires the analysis of information that establishes the feasibility of being installed, as well as the way to perform it.

In the case of the feasibility of being installed, the mechanical state information allows identifying the distribution of those accessories in the production rig, their location and characteristics (model, inside diameter, clearance between the device and the TP or TR), as well as the completion of the well which includes the casing diameter, its location and length, conditions where the accessories present an inside diameter smaller than the production tubing, its proximity to the zone to be repaired, presence of telescoped production tubing inverted and other circumstances that prevent the installation of the Device (D), must be considered. Those cases in which the access to the well present physical and/or administrative inconveniences, and/or the platform, cellar and christmas tree are not in adequate conditions may be reasons for the Device (D) not to be installed. Also the way it will be installed, type of slickline unit, surface equipment, slickline string, number of trips, trip speed, force of attachment impacts on Sections (1) and (II), and (VI) and (VII) depends on the information obtained through the geophysical logging unit (length of zone to be repaired), production logs (type of fluids, percentages, viscosity, presence of solids), gyroscopic (well deviation), intervention history (presence of obstructions) and others.

Device (D) installation method. The Device (D) installation considers two phases, a pre-installation phase and an installation operation phase. In the pre-installation phase, information is acquired to determine the operational requirements in equipment and slickline accessories to install the Device (D), as part of this information the mechanical condition, production history and interventions, electrical logs, gyroscopic and any other relevant operational record available are obtained; additionally, the site of the well to be intervened is visited to evaluate the conditions of its accesses, platform, cellar, christmas tree, and others available. In the operational phase of installation, the Device (D) is installed considering at least three trips with slickline unit in the following order:

1. Fastening of the First (I) and Second (II) sections on the production/casing pipe.
2. Lowering of the Upper Connector (in the Third section, III), Sleeves (20) (in the Fourth section, IV) and Fishing tool Connector (in the Fifth section, V), and fastening at the uppermost end of the Second section (II).

Lowering and fixing of the Sixth (VI) and Seventh (VII) sections inside the production/casing pipeline. Depending on the damage length of the production/casing pipeline, it will be the number of trips of the sleeves (20) and connectors indicated above, the more extended longitudinally the damage is, the greater the number of sleeves (20) required to isolate the altered zone.

It is important to mention that the length of the sleeves (20) to be placed in each descent is conditioned by the capacity of the slick line unit (SLU) as well as its accessories (lubricators).

It is important to keep in mind that, as part of the operating procedures in operations with slick line units, prior to lowering any tool, it is mandatory to calibrate the production/casing pipe to a diameter at least equal to the outside diameter of the Device (D), in order to guarantee its free descent and avoid jamming. This operation is performed only once before starting the fastening of the components that make up the Device (D).

Method of verifying the effectiveness of Device (D) installation. Verification of the effectiveness of the Device (D) installation is accomplished by measuring physical variables including pressure, flow rate, percentage of fluid production, and other physical variables and/or by taking logs including closed and open bottom pressure, electrical and other, either with a slick line unit or electrical logs. The criteria for defining the type of measurement is determined by the mechanical condition of the well and the type of leak detected, for clarity the following example is presented: in the case of a well with an annular space between the casing and production tubing, that has a packer at its lower end and has a leak detected in the production tubing, the effectiveness of the placement of the Device (D) will be verified by comparing the pressures between the annular space and the production tubing, which must be different; another scenario is the case of a well with production/casing pipe where a closed and flowing bottomhole pressure log can be run in the repaired zones in order to detect pressure and/or temperature variations, as well as production logging to detect changes in fluid input.

Method of recovery of the Device (D) to the surface. The recovery process of the Device (D) considers two stages, a so-called pre-recovery stage and an operational recovery stage. In the previous phase of recovery, information is acquired to determine the operational requirements in equipment and slick line accessories to recover the Device (D), as part of this information: detailed report of the Device (D) installation, updated well mechanical condition; production and intervention history; gyroscopic, and other available well information; additionally, the well to be intervened is visited to evaluate the conditions of its accesses, platform, cellar, christmas tree, and other relevant conditions for the operation. In the second operative stage the Device (D) is recovered to surface considering at least three trips with slick line unit and in the following order:

A. Recovery of the Sixth (VI) and Seventh (VII) sections attached to the production/casing tubing. This is done by breaking the Bolt-S (36) located in the Seventh section.

B. Surface retrieval of the Upper Connector (in the Third section), Sleeves (20) and Fishing tool Connector (in the Fifth section, V). This is done by upward strokes of the slick line string; in this case no release bolt is broken.

C. Recovery of the First (I) and Second (II) sections attached to the production/casing pipe. This is done by breaking the Bolt (14) located in the Second section.

Depending on the length of the repaired casing/production pipeline damage, it was the same number of sleeves and connectors installed, which should be recovered to the surface.

It is important to mention that the installed sleeves have a length which must be considered when selecting the capacity of the slick line unit (SLU) and its accessories (length of the lubricators).

It is important to keep in mind that, as part of the operating procedures in operations with slick line units, prior to the recovery of any tool, it is mandatory to calibrate the production/casing pipe to a diameter at least equal to the outside diameter of the Device (D), to guarantee its free recovery to the surface and avoid jamming. This operation is performed only once before starting the surface recovery of the components that make up the Device (D).

To show the best mode of application known by the applicant, the following is an example related to the system for the restoration of the mechanical integrity of reduced diameter casing or production pipes, object of the present invention and described above, without this limiting its technical scope.

EXAMPLE. A Device (D) is available as illustrated in FIG. 7 and manufactured with the materials proposed in the description of this invention; its external diameter is 57.785 mm (2.275 inches) and its length is 2.75 meters. This device is designed to be installed in a (88.900 mm), 13,694 kg/m (3½", 9.2 lb/ft) hydrocarbon production tubing (PT). Verify its hermeticity and anchoring capability, at pressures up to 20.684 MPa (~3,000.0 psia) when installed inside a production tubing (PT).

Materials and equipment. The fluid to transmit the pressure to (D) is water at 24° C.; a WOMA model 330-Z Triplex high pressure pump was used to generate pressure for testing, reaching maximum pressure values of 68.948 MPa (~10,000 psi) and maximum flow rate of 0.005317 $m^3/s$ (319.0 lt/min); The pressure control was performed with a Hi-Force pneumatic console, model AHP275, which allowed the automatic application of a pressure gradient defined in pressure increments of Dp=3.447 MPa (~500.0 psi), up to the test pressure of p=17.237 MPa (~2,500.0 psi).

Figure 15:
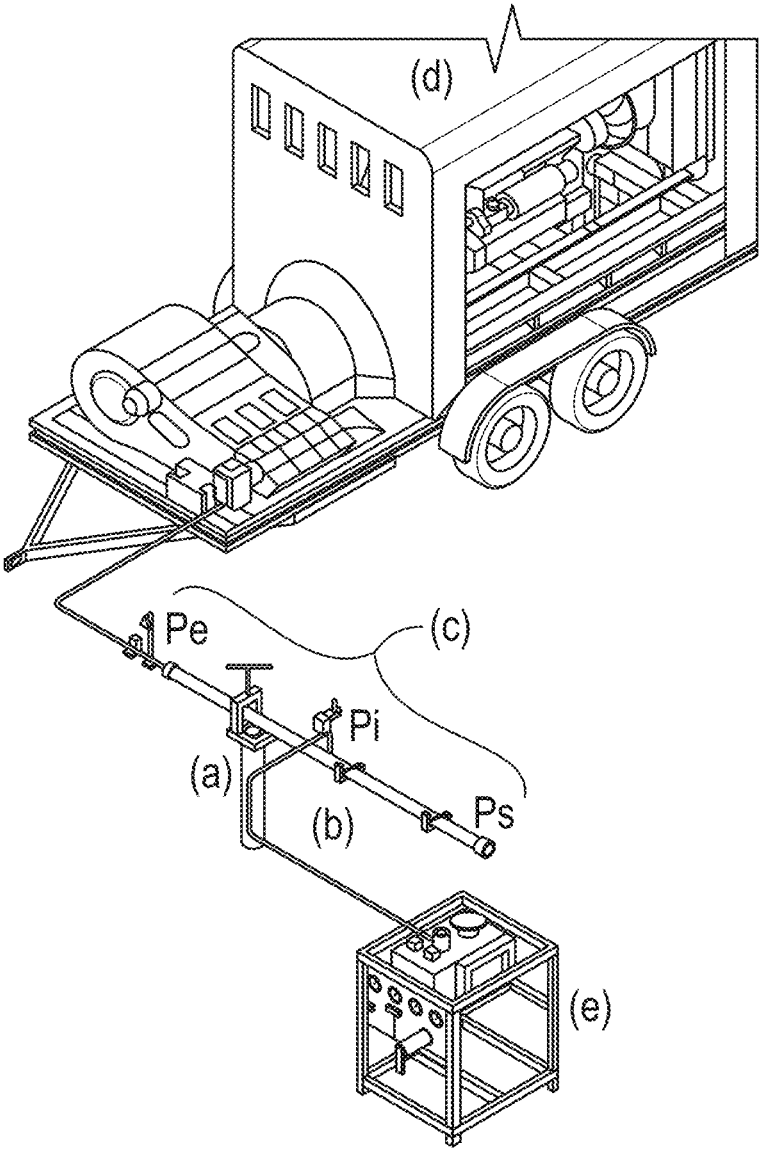
FIG. 15 shows the test configuration of Device (D).

Test procedure. A test bench was set up as illustrated in FIG. 15, where the following are indicated:

a) Pipeline support and backing.

b) Production tubing (PT) with its upper and lower plugs.

c) Pressure sensors at the inlet (Pe), outlet (Ps) and in the intermediate zone (Pi).

d) WOMA pump.

e) Hi-Force pneumatic console

I. INSTALLATION OF THE DEVICE (D) INSIDE THE PT

Figure 16:
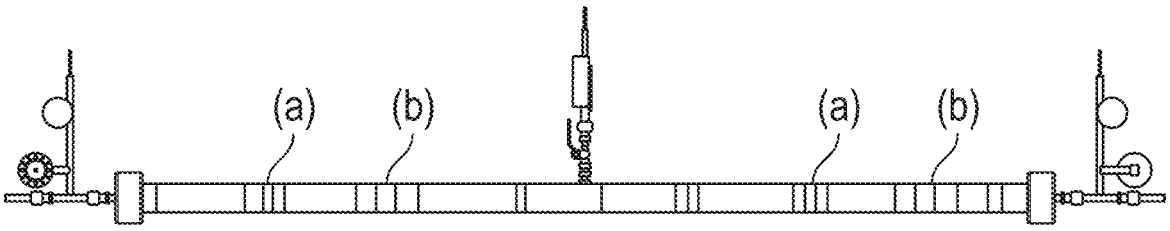
FIG. 16 shows the Device (D) in its original configuration and inside a production pipeline (TP) where a) packers and b) anchors are shown.
Figure 17:
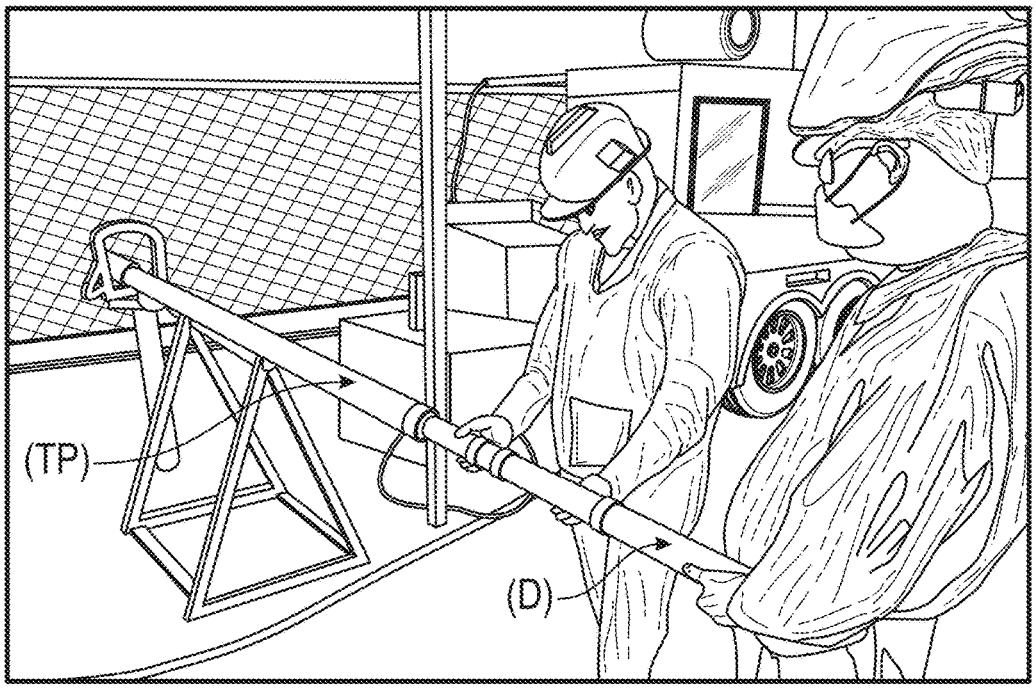
FIG. 17 shows the installation of Device (D), inside the TP.

Device (D) in its original design is shown in FIG. 16. The first stage of testing consists of installing Device (D) inside the PT in three trips; FIG. 17 shows a photograph of the moment of its installation, entering the PT.

Figure 18:
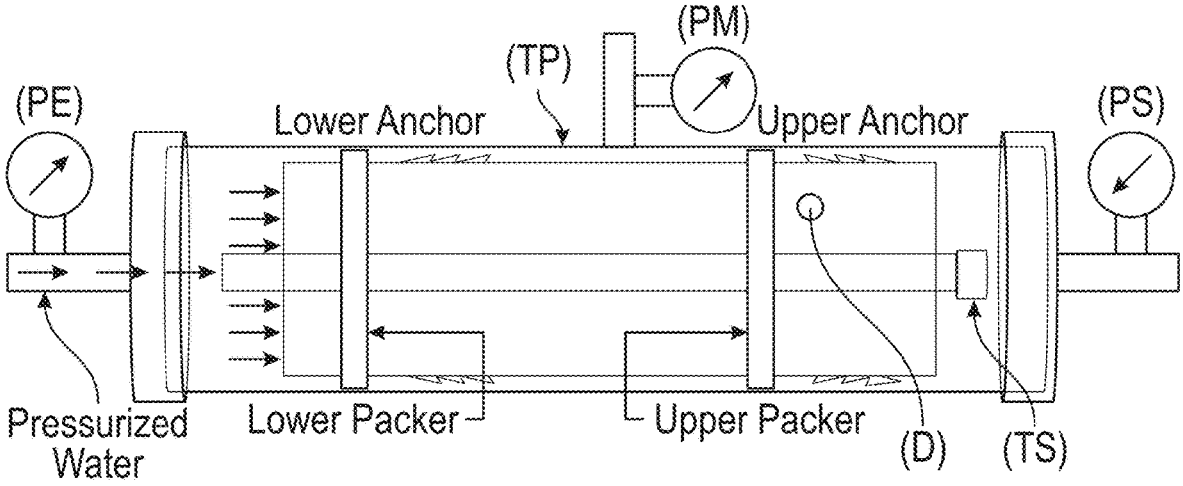
FIG. 18 illustrates the configuration diagram of the Device (D) within the (TP) to test the anchors.

In order to clearly illustrate the tests being performed, simplified schematics of the Device (D) similar to FIG. 18 are presented.

II. DEVICE ANCHORING SYSTEM TEST (D)

In the second stage, the anchoring system was tested, and the following steps were carried out:

1. A plug (TS) was placed at the outlet end of (D).
2. The Device (D) was installed inside the PT, with its lower and upper packers expanded and its anchors activated.
3. Pressurized water was applied through the PT inlet as illustrated in FIG. 18, in increments of 3.447 MPa (~500.0 psia) until reaching 20.684 MPa (~3,000.0 psia).
4. Once the target pressure was reached and the pressure holding time at this station was over, the pressure in the test stand was gradually decreased by 3.447 MPa (~500 psi) until atmospheric pressure was reached.

Figure 19:
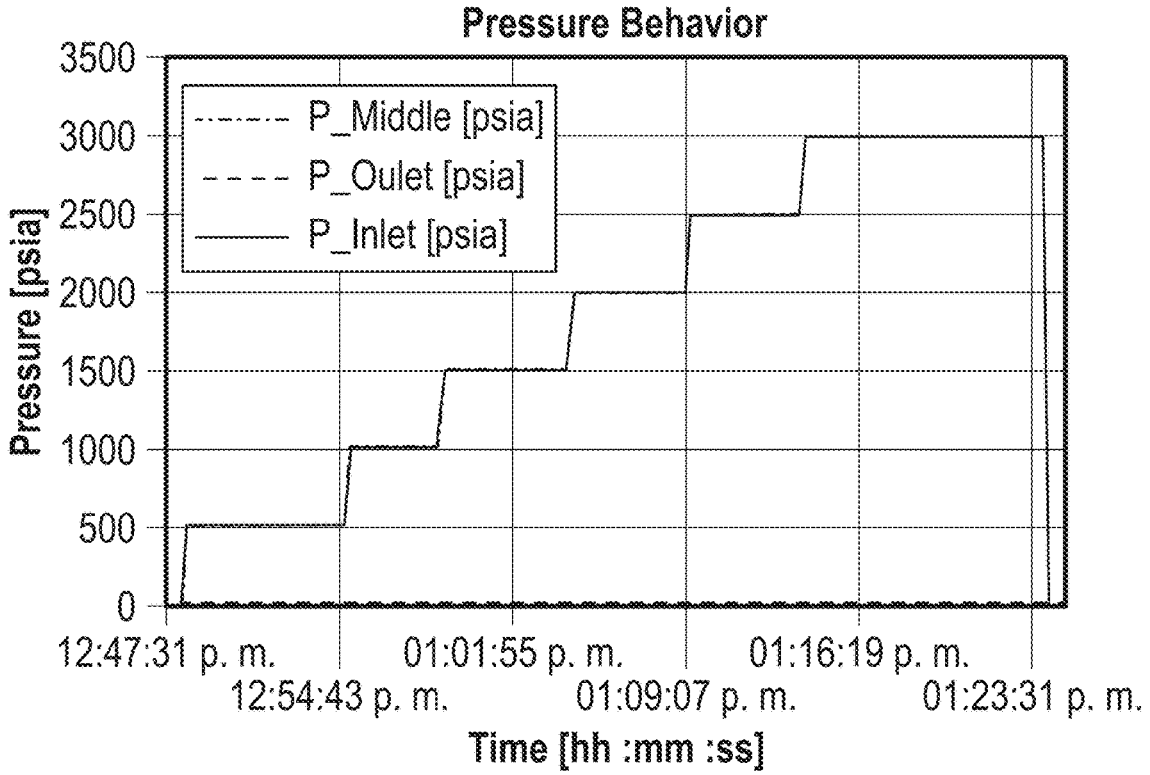
FIG. 19 shows the pressure recording in the inlet (PE), intermediate (PI) and outlet (PS) manometers during the anchoring test.

Results. FIG. 19 shows a graphical record of the response of the pressure gauges during the anchor test, successfully reaching 20.684 MPa (~3,000.0 psia), measured at several increments during the test.

III. DEVICE (D) HERMETICITY TEST

To perform the hermeticity test on Device (D), the following steps were carried out:

1. Both, the outlet plug of the TP with its pressure sensor and the inner plug of the Device (D) were removed.
2. Next, a TP outlet plug with pressure sensor and bleed valve was installed.
3. Pressurized water was applied through the PT inlet, as illustrated in FIG. 20, in increments of 3.447 MPa (~500.0 psia) until reaching 20.684 MPa (~3,000.0 psia).
4. The pressurized flow was allowed to exit through the bleed valve of the PT outlet plug for about 10 seconds to ensure proper filling of the tubing.
5. Open intermediate bleed valve.

Results. FIG. 21 shows a graphical record of the response of the gauges during the hermeticity test, up to 20.684 MPa (~3,000.0 psia), while the intermediate sensor pressure (PM) is null, measured during the test, which proved successful isolation outside the device, between the packers.

IV. DEVICE DIFFERENTIAL PRESSURE TEST (D)

To perform the differential pressure test on Device (D) the following steps were carried out:

1. Once the hermeticity and anchorage tests were completed satisfactorily, the pressure line from the pressure console was connected to the intermediate section of the TP of the test bench, as shown in FIG. 22.
2. The plugs were removed from the PT ends.
3. The differential pressure zone of the Device (D) was filled in its intermediate zone; the pressure was bled with the intermediate bleed valve.
4. With the differential pressure zone vented, proceed to perform a hermeticity test in the intermediate zone.
5. Pressure test was performed at 3.447 MPa (~500.0 psi) per station for 1 minute to 20.684 MPa (~3,000.0 psi). Punctually verifying that there were no water leaks in the connections and in the inlet and outlet plugs.

Note: If any leakage is reported, stop test, stop pumping and tighten connections and restart in step No. 3.

6. Once the target pressure was reached during the pressure holding time at this station, the pressure in the test stand was gradually decreased in decrements of 3.447 MPa (~500.0 psi) until atmospheric pressure was reached.
7. Finally, the purge valve of the intermediate section was opened.
8. The pressure data and the hydrostatic test graph were recorded along the test and saved.

Results. FIG. 23 shows a graphical record of the response of the gauges during the differential pressure test, up to 20.684 MPa (~3,000.0 psia), measured during the test.

V. CONCLUSIONS

Anchor test. Regarding the anchorage test, it was performed satisfactorily since the anchors withstood the thrust corresponding to 20.684 MPa (~3,000.0 psi) on the surface of the Device (D), without any relative longitudinal displacement of D with respect to the PT. The above allows concluding that the installation and recovery system of Device (D) worked correctly, moreover, the anchor activation mechanism operated correctly.

Hermeticity test. This test is intended to show the containment of pressures outside the packer gap; the pressure records show that the intermediate pressure, corresponding to the space between the packers, remained at atmospheric pressure throughout the test while the pressures at the ends of D gradually increased to 20.684 MPa (~3,000.0 psi), which was successfully accomplished. The above leads to the conclusion that the packer activation mechanism operated correctly.

Differential pressure test. This test is aimed at evaluating hydrostatic pressure containment in the space between packers. The pressure records show that the pressure gradually applied in the space between the packers remained confined in that space while outside the space the pressure remained equal to atmospheric pressure throughout the test, which evidenced the success of this test. This leads to the conclusion that the packer isolation mechanism operated correctly.

The invention claimed is:

1. A device for use in a system for restoring integrity of small diameter casing or production pipe in hydrocarbon reservoir wells, wherein the device comprises seven sections, assembled sequentially and adjacent to each other, wherein the seven sections comprise, in sequence, the following: a First Section (I) comprising a lower mechanical anchor; a Second Section (II) comprising a lower packer; a Third Section (III) comprising an upper connector; a Fourth Section (IV) comprising a plurality of longitudinally hollow cylindrical mechanical elements comprising sleeves; a Fifth Section (V) comprising a fishing tool connector; a Sixth Section (VI) comprising an upper mechanical anchor; and a Seventh Section (VII) comprising an upper packer, wherein said device is suitable for being placed inside a producing well to isolate zones of casing or production pipe that have anomalies selected from the group consisting of holes, perforations, and splits, and wherein said device simultaneously allows passage of hydrocarbon production fluids with other fluids, if any, along a longitudinal axis of the device.

2. The device according to claim 1, wherein: (a) the lower mechanical anchor is adapted for use for fixing a lowermost section of the device to a wall of the production or casing pipe; (b) the lower packer generates a rigid and hermetic seal between a lower part of the device and the wall of the production or casing pipe; (c) the upper connector is adapted for use for completing a rigid and hermetic connection between the lower packer and the sleeves of the Fourth Section (IV); (d) the Fourth Section (IV) isolates specific zones of the production or casing pipe and provides a way to flow hydrocarbon production fluids or other fluids using a plurality of sleeves that are configured to be connected and adjacent to each other; (e) the Fifth Section (V) comprising a fishing tool connector and male threaded termination for the rigid and hermetic connection between an uppermost sleeve of the Fourth Section (IV) and an uppermost mechanical anchor of the Sixth Section (VI); (f) the Sixth section (VI) comprising an upper mechanical anchor for attachment of the device, in an upper section of the device to the wall of the production or casing pipe; and (g) the Seventh Section (VII) including a mechanical system comprising an upper packer adapted to generate a rigid and hermetic seal between an upper part of the device and the wall of the production or casing pipe.

3. The device according to claim 2, wherein the length of each sleeve varies in the range of 0.305 m to 4.572 m (1 ft to 15 ft), wherein each sleeve has a lower end and each lower end has a male threaded connection, which is connected to the next successive sleeve with a female type threaded connection, where the lower end of a lowest sleeve is connected to the Third Section (III) by a male threaded connection and in an upper end to the next sleeve with a female threaded connection, wherein the uppermost sleeve is connected to the Fifth Section (V) by a female threaded connection at the upper end of the uppermost sleeve, where the connection between two successive sleeves includes an A-seal type O-ring, for which the sleeves, due to exposure to high stresses, are made of materials that withstand maximum tensions of 655.002 MPa, and where, due to exposure to oils, acids, abrasion, water vapor and heat, A-seal type O-rings are made of materials resistant to oils, acids, abrasion, water vapor and heat.

4. The device according to claim 1, wherein the lower mechanical anchor comprises expandable wedges adapted to fix the device inside the production or casing pipe, in the lower part of the device, wherein fixation is performed by mechanical interference between the production or casing pipe and the wedges of the lower mechanical anchor, said lower mechanical anchor being formed by a central body or a longitudinally hollow core having a wedge holder device, which partially supports the wedges by holding the wedges concentric to the core, wherein said core supports relative linear movement of a wedge-wedge holder assembly, where said wedge-wedge holder assembly is held together by a mechanical interference that restricts linear movement between the wedge and wedge holder, allowing radial movement of the wedges for opening, where the radial movement of the wedges is limited by a ring fixed to the core for the wedges to open, wherein the core has a conical section that supports the mechanical interference achieved between the device and the production or casing pipe.

5. The device according to claim 4, wherein the core and wedge holder are made of materials that withstand maximum stresses of 655.002 MPa, wherein the wedges are suitable to withstand high tensions and are resistant to shear stresses, and wherein the ring is made of resistant materials comprising stainless steel.

6. The device according to claim 4, wherein the bolt comprises a mechanical fuse function to recover the lower packer to surface when the bolt breaks, wherein the bolt is broken when the fishing tool engages in the captive sleeve by an upward impact to generate a shearing effect on the bolt due to the relative movement that exists with the lower packer core, where the lower packer is fixed to the wedge holder sleeve and the sealing cylinder on the upper part of the captive sleeve so as to generate a downward linear movement that is transferred to the lower packer core, the nose and the seal, thereby causing the Second Section (II) to reduce in length and the seal to expand, wherein, in order to prevent the Second Section (II) from recovering its initial length, the ratchet is activated to prevent the Second Section (II) from expanding after being compressed, wherein recovery of the First Section (I) and the Second Section (II) containing the lower mechanical anchor and the lower packer, respectively, is carried out by a fishing tool which strikes the captive sleeve in an upward manner, generating a shear stress on the bolt so that it breaks, which moves in a linear upward manner the nose, and both the seal and the wedges contract, simultaneously releasing the First Section (I) and the Second Section (II).

7. The device according to claim 1, wherein an uppermost part of the First Section (I) is rigidly and hermetically connected to the Second Section (II) with a truncated thread located in the core.

8. The device according to claim 1, wherein the Second Section (II) includes a lower packer mechanical system to generate a hermetic seal between the device and inside of the production or casing pipe by mechanical interference, wherein the device is suitable for being retrieved to a surface together with the lower mechanical anchor using a fishing tool, wherein the lower packer of the Second Section (II) is composed of a central element comprising a lower packer core, a wedge holder sleeve, a ratchet, a sealing cylinder, a polymeric ring or seal, a nose, a captive sleeve, two sealing rings, and a bolt.

9. The device according to claim 8, wherein the hermetic seal is achieved by mechanical interference between the polymeric ring, which expands during installation of the device, and an inner wall of the production or casing pipe, wherein the lower packer core allows for linear movement of the seal, nose, and captive sleeve, while holding concentric the wedge holder sleeve, sealing cylinder and ratchet, and also housing the sealing rings and bolt, where the wedge holder sleeve includes a union of the Second Section (II) with the First Section (I), and the union between them the First Section (I) and the Second Section (II) is achieved using a truncated threaded connection, internally housing the ratchet so that there is no relative movement between the First Section (I) and the Second Section (II), wherein the wedge holder sleeve is connected to the sealing cylinder at an upper end of the wedge holder sleeve, thereby comprising a physical barrier to support the seal and a guide suitable to obtain a desired deformation, wherein the nose generates a radial expansion of the seal as a consequence of linear movement of the seal on the core of the lower packer, wherein the upper part of the nose is connected to the captive sleeve by a threaded connection comprising a body having a housing for the bolt and having an upper part comprising another housing for placement and recovery using a fishing tool.

10. The device according to claim 9, wherein the wedge holder sleeve, the ratchet, the sealing cylinder, the nose, the captive sleeve and the bottom packer core are made of materials capable of withstanding a maximum stress of 655.002 MPa, wherein the bolt is made of SAE 64 bronze, and both the ring and seal are made of materials resistant to oils, acids, abrasion, steam and heat.

11. The device according to claim 1, wherein the upper connector is effective to form a rigid and hermetic connection between the packer of the Second Section (II) and the sleeves of the Fourth Section (IV), wherein the Second Section (II) is joined in an upper part thereof, rigidly and hermetically, to the Third Section (III) in a lower part thereof by a seal type union, inserting the threaded cap existing in the lower end of the upper connector, in the upper end of the Second Section (II), where the seal generating elements in the Third Section (III) are a Chevron type.

12. The device according to claim 11, wherein the upper connector and the threaded cap are made of materials withstanding maximum tensions of 655.002 MPa, and because the rings, middle rings, and V-seals, due to exposure thereof to oils, acids, abrasion, water vapor and heat, are made of materials resistant to the oils, acids, abrasion, water vapor and heat.

13. The device according to claim 1, wherein the connection between the Third Section (III) and the Second Section (II) is by mechanical interference by inserting the threaded cap of the Third Section (III) into the upper end of the Second Section (II), where the connection between the Third Section (III) at an upper end thereof and the Fourth Section (IV) at lower end thereof is by a male/female threaded connection, where the upper connector has a central space core for seals and incorporates a threaded connection at a lower end thereof where the threaded cap is housed, and V-seals in a middle part thereof wherein the core for seals houses at least two rings, at least one middle ring and a plurality of V-seals which are held without linear relative movement with respect to the core for seals by the threaded cap.

14. The device according to claim 1, wherein the Fourth Section (IV) includes sleeves comprising a plurality of cylindrical and longitudinally hollow mechanical elements connected to each other longitudinally in a rigid and hermetic way to generate a space in height and diameter and isolate one or several sections of production or casing pipe with anomalies in the wall or joints, where the sleeves are assisted by the packers of the Second Section (II) and the Seventh Section (VII) to make the isolation effective.

15. The device according to claim 1, wherein the Fifth Section (V) includes a fishing tool connector, which provides the rigid and hermetic connection between an uppermost sleeve of the Fourth Section (IV) and the mechanical anchor of the Sixth Section (VI), where the fishing tool connector comprises a cylindrical mechanical element, longitudinally hollow, incorporating in an uppermost part a fishing tool connection that allows the mechanical and hermetic connection with the upper mechanical anchor of the Sixth Section (VI), for its positioning/recovery and with threaded termination at its lower end, wherein the fishing tool connector is manufactured from materials that withstand maximum stresses of 655.002 MPa.

16. The device according to claim 1, wherein the Sixth Section (VI) includes an upper mechanical anchor, which has wedges that fix the device inside the production or casing pipe by an upper part thereof, where the fixation is achieved by mechanical interference between the production or casing pipe and the wedges of the anchor by radial expansion, where the upper mechanical anchor includes a central body or core, longitudinally hollow, which partially supports the wedges, wherein a wedge holder holds the wedges concentric to the core, which controls the relative linear motion of a wedge-wedge holder assembly, where the wedge-wedge holder assembly is held together by a mechanical interference that restricts the linear motion between the wedges, having radial movement in the form of the opening of the wedges.

17. The device according to claim 16, wherein the radial movement of the wedges is limited by a metal ring, fixed to the core by screws where, in order to achieve opening of the wedges, the core has a cone section that, in addition to generating the opening of the wedges, supports the mechanical interference achieved with the production or casing pipe, where the wedges are resistant to high tension and shear stresses, and both the core and wedge holder are made of materials that withstand maximum tensions of 655.002 MPa (95,000.0 psi), and the ring is made of stainless steel.

18. The device according to claim 17, wherein an uppermost part of the Sixth Section (VI) is rigidly and hermetically connected to the Seventh Section (VII) by a truncated threaded connection, and includes an O-ring there between.

19. The device according to claim 1, wherein the Seventh Section (VII) comprises an upper packer mechanical system, which, together with the lower packer, generates a hermetic seal between the device and inside of the production or casing pipe with anomalies in wall and/or joints thereof, at the upper and lower ends of the device, and where the seal is made by mechanical interference between a polymeric seal, which expands during installation of the device, and an inner wall of the production or casing pipe, where the upper packer is composed of: a central element comprising an upper packer core, a wedge holder sleeve, a ratchet, a tightness cylinder, a seal, a nose, a captive sleeve, two rings, and a bolt.

20. The device according to claim 19, wherein the upper packer core enables the linear movement of the seal, nose, and captive sleeve, and holds concentric the wedge holder sleeve, the tightness cylinder, and the ratchet, and houses internal hermeticity elements comprising the seals and a release-element comprising the bolt.

21. The device according to claim 19, wherein the wedge holder sleeve, which is located in a lowermost part of the Seventh Section (VII), enables the connection of the Seventh Section (VII) with an uppermost part of the Sixth Section (VI) by a truncated thread, and internally accommodates the ratchet so that there is no relative movement between the Sixth Section (VI) and the Seventh Section (VII), the wedge holder sleeve being in contact with the tightness cylinder during placement/retrieval, where the tightness cylinder comprises a physical support for the seal and a guide to obtain the desired deformation of the seal, where the nose generates the radial expansion of the seal as a consequence of linear movement thereof on the upper packer core, connecting in the upper part thereof, the nose with the captive sleeve by a threaded connection, where, the captive sleeve includes in a body thereof a housing for the bolt, and in an upper part thereof another housing for positioning/recovery thereof by a fishing tool, wherein the bolt has a mechanical fuse function to simultaneously retrieve to the surface the top anchor and the top packer when the latter breaks, and wherein, to break the bolt, a fishing tool, engages in the captive sleeve and by an upward impact generates a shearing effect on the bolt due to a relative movement that exists with the top packer core.

22. The device according to claim 19, wherein the sealing of the upper packer occurs when, being fixed the wedge holder sleeve and the tightness cylinder, by a bolt on the upper part of the captive sleeve, a linear downward movement is generated and transferred to the packer core, the nose, and the seal, causing the device to reduce in length and the seal to expand, and wherein the ratchet prevents the upper packer of this section from regaining its initial length.

23. The device according to claim 19, wherein recovery of the upper packer and mechanical anchor occurs with use of a fishing tool when the captive sleeve is struck upwards to generate a shear stress on the bolt so that the bolt breaks, thereby causing upward linear movement of the upper packer and mechanical anchor, and of the nose, along with the contraction of the seal, thereby releasing the upper packer, mechanical anchor, and nose simultaneously.

24. The device according to claim 19, wherein the wedge holder sleeve, the ratchet, the tightness cylinder, the nose, the captive sleeve, and the upper packer core are made of materials capable of withstanding tensions up to 655.002 MPa, and the ring and the seal are made of materials resistant to oils, acids, abrasion, steam and heat.

25. The device according to claim 19, wherein the Seventh Section (VII), in its upper part, has a fishing tool access for placement and removal thereof, and is joined to the Sixth Section (VI) by a truncated thread.

26. A method of restoring mechanical integrity of a reduced diameter casing or production pipe in a hydrocarbon reservoir well, comprising: installing the device according to claim 1 into a hydrocarbon reservoir well; using the device to verify effectiveness of the installation of the device; and recovering the device to the surface, said method being used in hydrocarbon reservoir wells where the fluid pressure is less than or equal to 34.474 MPa.

27. The method according to claim 26, wherein verifying the effectiveness of the installation of the device comprises: processing information on mechanical condition of the well, geometrical properties of the well selected from the group consisting of an inside diameter, annular spacing, model, and geometrical constraints of the well; distribution of existing accessories in the production rig; analyzing accesses to the vicinity of the well, and the conditions and surface equipment required to install the device; determining the number of trips, the speed of trips and the necessary force of impacts to fix the First Section (I), the Second Section (II), the Sixth Section (VI), and the Seventh Section (VII) determining the depth and length of the zone to be repaired, type of fluids to be used, production percentages, fluids viscosity, presence of solids, and properties thereof; and specifying the trajectory of the well and intervention history thereof.

28. The method according to claim 26, wherein the installation comprises: a) in a first phase, the determination of the operational requirements on equipment and slick line accessories to install the device, and b) in a second phase, performing a first trip of the First Section (I) and the Second Section (II) of the device to a required depth, where the First Section (I) and the Second Section (II) are mechanically anchored and hermetic sealing of the Second Section (II) is performed, wherein once these are installed, the Third Section (III), the Fourth Section (IV), and the Fifth Section (V) are lowered and installed in that order, connected to an upper end of the Second Section (II), so that, once the First Section (I), the Second Section (II), the Third Section (III), the Fourth Section (IV), and the Fifth Section (V) are installed, the Sixth Section (VI) and the Seventh Section (VII) are lowered and installed in that order, and then connected to an upper end of the Fifth Section (V).

29. The method according to claim 26, wherein verifying the effectiveness of the installation the device comprises: a) measuring physical variables of pressure, flow rate, percentage of fluid production, temperature and/or recording of pressure for both, closed and open bottom, temperature, resistive or inductive logs, with slick line or electrical logs and; b) determining, by mechanical information of the well and type of leak detected, the effectiveness of the device by comparing the existing pressures in annular space and in the production pipe, or pressure logging at closed and flowing bottomhole in repaired zones in order to detect pressure and/or temperature variations, and production logging to detect changes in fluid supply.

30. The method according to claim 26, wherein retrieving the device comprises: a) in a first stage, acquisition of information to determine operating requirements in equipment and slick line accessories to recover the device, which includes a detailed device installation report, updated mechanical condition of the well, production and intervention history, gyroscopic logs, and other available well information, well visitation to evaluate accessing conditions, platform, cellar, christmas tree, and other conditions relevant to operation and, b) in a second stage, the Sixth Section (VI) and the Seventh Section (VII) attached to the casing or production pipe are recovered by causing a bolt located in the Seventh Section (VII) to rupture by a sudden upward force, then, after lifting the Sixth Section (VI) and Seventh Section (VII) to the surface, the Fifth Section (V) containing the fishing tool connector, the sleeves used in the Fourth Section (IV) and the Third Section (III) including the upper connector are recovered to the surface, which is done by upward strokes of a slick line string, where, in this case, no release bolt is broken in the Third Section (III) and the Fourth Section (IV), thereafter retrieving the Third Section (III), Fourth Section (IV), Fifth Section (V), Sixth Section (VI), and Seventh Section (VII), and retrieving the Second Section (II) and First Section (I) attached to the casing or production pipe by breaking a bolt located in the Second Section (II).

* * * * *